US007784615B2

(12) United States Patent
Stahl

(10) Patent No.: US 7,784,615 B2
(45) Date of Patent: Aug. 31, 2010

(54) NESTABLE AND STACKABLE CONTAINER FOR THE TRANSPORT OF HEAVY BAKED ITEMS

(75) Inventor: Edward L. Stahl, Tyler, TX (US)

(73) Assignee: Orbis Canada Limited, Toronto, Ontario (CA)

( * ) Notice: Subject to any disclaimer, the term of this patent is extended or adjusted under 35 U.S.C. 154(b) by 59 days.

(21) Appl. No.: 11/755,716

(22) Filed: May 30, 2007

(65) Prior Publication Data

US 2008/0296194 A1 Dec. 4, 2008

(51) Int. Cl.
*B65D 21/032* (2006.01)

(52) U.S. Cl. ..... 206/511

(58) Field of Classification Search ..... 206/518, 206/519, 515, 505, 504; 220/23.86, 631, 220/628, 608, 556, 555, 553, 527, 529, 532, 220/533, 557, 554; D9/761, 737; D7/549, D7/546; *B65D 21/036, 21/032, 21/02*
See application file for complete search history.

(56) References Cited

U.S. PATENT DOCUMENTS

| | | | | |
|---|---|---|---|---|
| 2,026,204 | A | 12/1935 | Andrews | |
| 2,029,746 | A | 2/1936 | Tufts et al. | |
| 2,061,414 | A | 11/1936 | Tufts et al. | |
| 2,134,875 | A | 11/1938 | Henze | |
| 2,457,841 | A | 1/1949 | Smith et al. | |
| 2,457,842 | A | 1/1949 | Smith et al. | |
| 2,609,120 | A | 9/1952 | Williams | |
| 2,641,383 | A | 6/1953 | Coursey | |
| 2,918,379 | A | 12/1959 | Lurie | |
| 3,154,215 | A | 10/1964 | Le Vesconte | |
| 3,200,988 | A * | 8/1965 | De Chelbor | 206/509 |
| 3,375,953 | A | 4/1968 | Miller, Jr. | |

(Continued)

FOREIGN PATENT DOCUMENTS

CA 892971 2/1972

(Continued)

OTHER PUBLICATIONS

Canadian Official Action for Canadian Patent Application No. 2,431,444 dated Dec. 12, 2005 (2 pages).

(Continued)

*Primary Examiner*—Anthony Stashick
*Assistant Examiner*—Robert J Hicks
(74) *Attorney, Agent, or Firm*—Ungaretti & Harris, LLP

(57) ABSTRACT

A container for containing and transporting baked goods includes a front wall, left side wall, rear wall and a right side wall, wherein each of the walls is substantially orthogonal to a base. The base includes a substantially flat, smooth upper surface. Integrally formed as part of and rising from the base are a plurality of base projections, each with a plurality of sloped curved wall surfaces. There are at least two stacking feet per wall of the container. The container further includes 180° stacking recesses located on a rim that surrounds the container and that substantially prevent an upper container from shifting or sliding when stacked in a 180° stacking orientation, preferably for the transportation of baked goods. Each of the recesses further comprises a "U" or "[" shaped projection to interface and retain the stacking feet of an upper container when stacked in the 180° stacking orientation.

18 Claims, 16 Drawing Sheets

U.S. PATENT DOCUMENTS

| | | | | | |
|---|---|---|---|---|---|
| 3,379,339 | A | | 4/1968 | Asenbauer | |
| 3,387,740 | A | | 6/1968 | Bockenstette | |
| 3,392,875 | A | * | 7/1968 | Bockenstette | 206/507 |
| 3,420,402 | A | | 1/1969 | Frater et al. | |
| 3,421,656 | A | | 1/1969 | Asenbauer | |
| 3,430,806 | A | * | 3/1969 | Munk et al. | 206/507 |
| 3,521,808 | A | * | 7/1970 | Weiss | 206/564 |
| 3,570,697 | A | | 3/1971 | Langston | |
| 3,613,943 | A | * | 10/1971 | Bridenstine | 206/507 |
| 3,659,743 | A | | 5/1972 | Box | |
| 3,752,352 | A | | 8/1973 | Senecal | |
| 3,780,905 | A | | 12/1973 | Herolzer | |
| D236,168 | S | | 7/1975 | Johnson | |
| 3,907,111 | A | | 9/1975 | Levenhagen | |
| 3,934,724 | A | | 1/1976 | Johnson | |
| 3,951,265 | A | | 4/1976 | Carroll | |
| 3,952,903 | A | | 4/1976 | Sanders et al. | |
| 3,993,211 | A | | 11/1976 | Astle | |
| 4,000,817 | A | | 1/1977 | Sanders et al. | |
| 4,093,070 | A | | 6/1978 | Stahl | |
| 4,093,071 | A | | 6/1978 | Stahl et al. | |
| 4,102,453 | A | | 7/1978 | Carroll et al. | |
| 4,105,117 | A | | 8/1978 | Atkin et al. | |
| 4,106,623 | A | | 8/1978 | Carroll et al. | |
| 4,106,624 | A | | 8/1978 | Thurman | |
| 4,106,625 | A | | 8/1978 | Carroll et al. | |
| 4,109,791 | A | | 8/1978 | Clipson et al. | |
| 4,113,329 | A | * | 9/1978 | Thurman | 312/111 |
| 4,189,052 | A | | 2/1980 | Carroll et al. | |
| 4,194,626 | A | | 3/1980 | Boller | |
| 4,211,327 | A | | 7/1980 | Stahl et al. | |
| D258,050 | S | | 1/1981 | Cornou | |
| 4,247,004 | A | | 1/1981 | Bird | |
| 4,316,154 | A | | 2/1982 | Krause | |
| 4,316,540 | A | * | 2/1982 | Lapham | 206/507 |
| 4,320,837 | A | | 3/1982 | Carroll et al. | |
| 4,391,369 | A | | 7/1983 | Stahl et al. | |
| 4,423,813 | A | | 1/1984 | Kreeger et al. | |
| 4,426,001 | A | | 1/1984 | Stahl et al. | |
| 4,440,302 | A | | 4/1984 | Ehrman et al. | |
| 4,466,541 | A | | 8/1984 | Tabler et al. | |
| 4,520,928 | A | | 6/1985 | Wilson | |
| 4,523,681 | A | | 6/1985 | Kreeger | |
| 4,573,577 | A | | 3/1986 | Miller | |
| 4,577,759 | A | | 3/1986 | Kreeger | |
| 4,600,103 | A | | 7/1986 | Tabler | |
| 4,601,393 | A | | 7/1986 | Veenman et al. | |
| RE32,223 | E | | 8/1986 | Kreeger et al. | |
| 4,619,366 | A | | 10/1986 | Kreeger | |
| 4,619,371 | A | | 10/1986 | Rehrig | |
| 4,643,310 | A | | 2/1987 | Deaton et al. | |
| 4,671,411 | A | | 6/1987 | Rehrig et al. | |
| D292,634 | S | | 11/1987 | Chabot | |
| 4,759,451 | A | | 7/1988 | Apps | |
| 4,848,578 | A | | 7/1989 | Schafer | |
| 4,863,062 | A | | 9/1989 | Holliday | |
| 4,905,833 | A | | 3/1990 | Kreeger et al. | |
| 4,936,458 | A | | 6/1990 | Tabler et al. | |
| 4,947,992 | A | | 8/1990 | Schafer | |
| 4,960,207 | A | | 10/1990 | Tabler et al. | |
| 4,982,844 | A | | 1/1991 | Madan et al. | |
| 5,035,326 | A | | 7/1991 | Stahl | |
| D319,908 | S | | 9/1991 | Stahl | |
| D320,298 | S | | 9/1991 | Apps et al. | |
| 5,096,085 | A | * | 3/1992 | Eek et al. | 220/516 |
| 5,163,587 | A | | 11/1992 | Apps et al. | |
| D343,042 | S | | 1/1994 | Apps et al. | |
| D344,387 | S | | 2/1994 | Holliday | |
| 5,287,966 | A | | 2/1994 | Stahl | |
| D348,138 | S | | 6/1994 | Lang-Ree et al. | |
| D348,342 | S | | 6/1994 | Lang-Ree et al. | |
| D348,343 | S | | 6/1994 | Lang-Ree et al. | |
| D350,028 | S | | 8/1994 | Apps | |
| D350,437 | S | | 9/1994 | Apps et al. | |
| 5,344,021 | A | | 9/1994 | Rose | |
| 5,344,022 | A | | 9/1994 | Stahl | |
| 5,372,257 | A | | 12/1994 | Beauchamp et al. | |
| D354,167 | S | | 1/1995 | Stahl | |
| 5,377,858 | A | | 1/1995 | Morris, Sr. | |
| 5,392,915 | A | | 2/1995 | Kalin | |
| 5,415,293 | A | | 5/1995 | Ackermann et al. | |
| 5,469,986 | A | | 11/1995 | Jang | |
| 5,494,163 | A | | 2/1996 | Apps | |
| D374,555 | S | | 10/1996 | McMath | |
| 5,582,296 | A | | 12/1996 | Beauchamp et al. | |
| 5,609,254 | A | | 3/1997 | Loftus et al. | |
| 5,617,953 | A | | 4/1997 | Cope | |
| D379,718 | S | | 6/1997 | Raghunathan | |
| D381,203 | S | | 7/1997 | Ackermann et al. | |
| D382,404 | S | | 8/1997 | Cope | |
| D384,975 | S | | 10/1997 | Jackson | |
| 5,735,431 | A | | 4/1998 | LeTrudet | |
| 5,752,602 | A | | 5/1998 | Ackermann et al. | |
| 5,772,033 | A | | 6/1998 | Loftus et al. | |
| D398,448 | S | | 9/1998 | Zanni | |
| D400,711 | S | | 11/1998 | Hwang | |
| D401,066 | S | | 11/1998 | Ackermann | |
| D401,412 | S | | 11/1998 | LeTrudet | |
| 5,860,527 | A | | 1/1999 | Frankenberg et al. | |
| 5,881,902 | A | | 3/1999 | Ackermann | |
| 5,896,987 | A | | 4/1999 | Bettenhausen | |
| 5,924,572 | A | | 7/1999 | Cope | |
| 5,975,324 | A | | 11/1999 | Schmitt | |
| 5,992,673 | A | | 11/1999 | Hwang | |
| 6,015,056 | A | | 1/2000 | Overholt et al. | |
| D420,219 | S | | 2/2000 | Elvin-Jensen et al. | |
| 6,036,049 | A | | 3/2000 | Hwang | |
| D423,217 | S | | 4/2000 | Varfeldt | |
| D424,299 | S | | 5/2000 | Varfeldt | |
| 6,059,114 | A | | 5/2000 | Loftus | |
| 6,089,373 | A | | 7/2000 | Cope | |
| D429,565 | S | | 8/2000 | Aiken | |
| 6,098,827 | A | | 8/2000 | Overholt et al. | |
| 6,138,863 | A | | 10/2000 | Aiken | |
| D436,729 | S | | 1/2001 | Aiken | |
| D439,049 | S | | 3/2001 | Koefelda | |
| 6,209,742 | B1 | | 4/2001 | Overholt et al. | |
| 6,250,490 | B1 | | 6/2001 | Loftus | |
| 6,260,706 | B1 | | 7/2001 | Koefelda | |
| D446,017 | S | | 8/2001 | Koefelda | |
| D446,392 | S | | 8/2001 | Overholt et al. | |
| D446,939 | S | | 8/2001 | Koefelda | |
| 6,273,259 | B1 | | 8/2001 | Stahl | |
| 6,293,418 | B1 | | 9/2001 | Ogden et al. | |
| 6,308,858 | B1 | | 10/2001 | Koefelda | |
| D452,614 | S | | 1/2002 | Overholt | |
| 6,338,181 | B1 | | 1/2002 | Hwang | |
| 6,386,388 | B1 | | 5/2002 | Overholt | |
| 6,394,274 | B1 | | 5/2002 | Cheeseman | |
| D458,753 | S | | 6/2002 | Overholt et al. | |
| 6,398,054 | B1 | | 6/2002 | Overholt et al. | |
| 6,405,888 | B1 | | 6/2002 | Overholt et al. | |
| 6,409,041 | B1 | | 6/2002 | Overholt et al. | |
| D460,619 | S | | 7/2002 | Koefelda | |
| D463,667 | S | | 10/2002 | Hwang | |
| 6,460,717 | B1 | | 10/2002 | Smyers et al. | |
| D478,421 | S | | 8/2003 | Overholt et al. | |
| 6,601,724 | B1 | | 8/2003 | Koefelda et al. | |
| 6,607,199 | B2 | | 8/2003 | Gruber | |
| 6,631,822 | B1 | | 10/2003 | Overholt | |
| D487,634 | S | | 3/2004 | Apps et al. | |
| 6,843,386 | B2 | | 1/2005 | Raghunathan et al. | |
| 6,857,642 | B2 | | 2/2005 | Gruber | |
| 6,863,180 | B2 | | 3/2005 | Apps et al. | |

| | | | |
|---|---|---|---|
| 6,880,705 | B2 | 4/2005 | Otting et al. |
| 6,886,710 | B2 | 5/2005 | Verna et al. |
| 6,899,242 | B2 | 5/2005 | Overholt et al. |
| 6,918,502 | B1 | 7/2005 | Overholt et al. |
| 6,918,508 | B2 | 7/2005 | Hwang |
| 6,938,772 | B2 | 9/2005 | Aiken et al. |
| 6,994,216 | B2 | 2/2006 | Wong |
| 7,014,043 | B2 | 3/2006 | Raghunathan et al. |
| 7,017,745 | B2 | 3/2006 | Raghunathan |
| 7,017,766 | B2 | 3/2006 | Hsu et al. |
| 7,044,319 | B2 | 5/2006 | Overholt et al. |
| 7,048,134 | B1 | 5/2006 | Hagan |
| 7,048,135 | B2 | 5/2006 | Smyers et al. |
| 7,059,489 | B2 | 6/2006 | Apps et al. |
| 7,063,210 | B2 | 6/2006 | Smyers et al. |
| 7,086,555 | B2 | 8/2006 | Overholt et al. |
| 7,100,786 | B2 | 9/2006 | Smyers |
| 7,104,414 | B2 | 9/2006 | Apps et al. |
| 7,104,553 | B2 | 9/2006 | Gruber |
| 7,128,231 | B2 | 10/2006 | Overholt |
| 7,195,127 | B2 | 3/2007 | Hsu et al. |
| 7,234,599 | B2 | 6/2007 | Hassell et al. |
| 7,249,675 | B2 | 7/2007 | Hassell et al. |
| 7,264,122 | B2 | 9/2007 | Koefelda et al. |
| 2002/0056717 | A1 | 5/2002 | Hwang |
| 2002/0130132 | A1 | 9/2002 | Overholt |
| 2002/0148842 | A1 | 10/2002 | Overholt et al. |
| 2002/0153682 | A1 | 10/2002 | Gruber |
| 2002/0158067 | A1 | 10/2002 | Overholt et al. |
| 2002/0179480 | A1 | 12/2002 | Raghunathan et al. |
| 2003/0024845 | A1 | 2/2003 | Smyers et al. |
| 2003/0042255 | A1 | 3/2003 | Smyers et al. |
| 2003/0116564 | A1 | 6/2003 | Overholt et al. |
| 2003/0132228 | A1 | 7/2003 | Apps et al. |
| 2003/0155275 | A1 | 8/2003 | Apps et al. |
| 2003/0222081 | A1 | 12/2003 | Apps et al. |
| 2003/0230510 | A1 | 12/2003 | Aiken et al. |
| 2004/0020821 | A1 | 2/2004 | Koefelda et al. |
| 2004/0050742 | A1 | 3/2004 | Gruber |
| 2004/0060844 | A1 | 4/2004 | Stahl |
| 2004/0069780 | A1 | 4/2004 | Apps et al. |
| 2004/0099662 | A1 | 5/2004 | Overholt |
| 2004/0104231 | A1 | 6/2004 | Hassell et al. |
| 2004/0144680 | A1 | 7/2004 | Stahl |
| 2004/0155048 | A1 | 8/2004 | Aiken |
| 2004/0178197 | A1 | 9/2004 | Hsu et al. |
| 2004/0182858 | A1 | 9/2004 | Smyers |
| 2004/0195139 | A1 | 10/2004 | Wong |
| 2004/0226945 | A1 | 11/2004 | Hsu et al. |
| 2004/0245142 | A1 | 12/2004 | Raghunathan |
| 2005/0140107 | A1 | 6/2005 | Gruber |
| 2005/0183980 | A1 | 8/2005 | Fernandez et al. |
| 2005/0224385 | A1 | 10/2005 | Hassell et al. |
| 2005/0263423 | A1 | 12/2005 | Hassell et al. |
| 2005/0263424 | A1 | 12/2005 | Hassell et al. |
| 2006/0011627 | A1 | 1/2006 | Overholt et al. |
| 2006/0065567 | A1 | 3/2006 | Hassell et al. |
| 2006/0070906 | A1 | 4/2006 | Verna et al. |
| 2006/0096883 | A1 | 5/2006 | Raghunathan et al. |
| 2006/0108372 | A1 | 5/2006 | Aiken et al. |
| 2006/0118450 | A1 | 6/2006 | Stahl |
| 2006/0180491 | A1 | 8/2006 | Zephir et al. |
| 2006/0186123 | A1 | 8/2006 | Baltz et al. |
| 2006/0196800 | A1 | 9/2006 | Baltz |
| 2006/0231449 | A1 | 10/2006 | Hassell et al. |
| 2006/0231555 | A1 | 10/2006 | Smyers et al. |
| 2006/0237341 | A1 | 10/2006 | McDade |
| 2007/0056874 | A1 | 3/2007 | Apps et al. |
| 2007/0144931 | A1 | 6/2007 | McTavish et al. |
| 2007/0175790 | A1 | 8/2007 | Fernandez et al. |
| 2007/0187276 | A1 | 8/2007 | Stahl |

FOREIGN PATENT DOCUMENTS

| | | |
|---|---|---|
| CA | 1273881 | 9/1990 |
| CA | 2032012 | 6/1991 |
| CA | 2129617 | 2/1995 |
| CA | 2130973 | 3/1995 |
| CA | 2212239 | 8/1996 |
| CA | 2484830 | 8/1996 |
| CA | 2313137 | 7/1999 |
| CA | 2296895 | 7/2000 |
| CA | 2326118 | 5/2001 |
| CA | 2387491 | 5/2001 |
| CA | 2389010 | 5/2001 |
| CA | 2392265 | 6/2001 |
| CA | 2395367 | 7/2001 |
| CA | 2397522 | 8/2001 |
| CA | 2406099 | 10/2001 |
| CA | 2408247 | 11/2001 |
| CA | 2384941 | 1/2002 |
| CA | 2421595 | 3/2002 |
| CA | 2426949 | 5/2002 |
| CA | 2367649 | 7/2002 |
| CA | 2442723 | 10/2002 |
| CA | 2455355 | 2/2003 |
| CA | 2458773 | 3/2003 |
| CA | 2472360 | 7/2003 |
| CA | 2475531 | 9/2003 |
| CA | 2485544 | 12/2003 |
| CA | 2448920 | 7/2004 |
| CA | 2431444 | 12/2004 |
| DE | 3511321 | 10/1986 |
| DE | 3521894 | 1/1987 |
| DE | 20002537 | 6/2001 |
| EP | 0368713 | 5/1990 |
| EP | 370771 | 5/1990 |
| EP | 0557002 | 8/1993 |
| EP | 697341 | 2/1996 |
| EP | 926073 | 6/1999 |
| EP | 953509 | 11/1999 |
| FR | 1131652 | 2/1957 |
| FR | 2678585 | 1/1993 |
| GB | 2067167 | 7/1981 |
| GB | 2124588 | 2/1984 |
| GB | 2129401 | 5/1984 |
| GB | 2137167 | 10/1984 |
| GB | 2141778 | 1/1985 |
| GB | 2171980 | 9/1986 |
| GB | 2180821 | 4/1987 |
| GB | 2209737 | 5/1989 |
| GB | 2296009 | 6/1996 |
| GB | 2333285 | 7/1999 |
| GB | 2340485 | 2/2000 |
| GB | 2350350 | 11/2000 |
| GB | 2373239 | 9/2002 |
| GB | 2374859 | 10/2002 |
| GB | 2373240 | 1/2008 |
| NL | 7905105 | 12/1980 |
| TW | 338405 | 8/1998 |
| TW | 372539 | 10/1999 |
| WO | 9801352 | 1/1998 |
| WO | 0027716 | 5/2000 |
| WO | 0051900 | 9/2000 |
| WO | 0066440 | 11/2000 |
| WO | 0185558 | 11/2001 |
| WO | 2006062899 | 6/2006 |

OTHER PUBLICATIONS

Canadian Official Action for Canadian Patent Application No. 2,408,247 dated Nov. 24, 2005 (3 pages).

International Preliminary Examination Report dated Sep. 10, 2002, issued in PCT/CA01/00640 (11 pages).
Correspondence regarding European Patent Application No. 01 931 236.6-2308 dated May 27, 2004 (2 pages).
Correspondence regarding European Patent Application No. 01 931 236.6-2308 dated Jun. 2, 2005 (3 pages).

* cited by examiner

NESTABLE AND STACKABLE CONTAINER FOR THE TRANSPORT OF HEAVY BAKED ITEMS

BACKGROUND OF THE INVENTION

1. Field of the Invention

The invention relates to containers designed to carry baked products. More particularly, the invention relates to a container for the transport of heavy, baked flour and corn tortillas, while protecting the same from inadvertent markings and indentations.

2. Background Art

In the baked goods industry, many different types of containers exist that can be used for the transport and conveyance of the baked goods. Generally, these baked goods are light, fluffy, yeast-risen products, that are relatively light in weight, although they can be bulky. With the substantial rise in the United States and other locations of people of Hispanic heritage, tortillas have become much more popular. Tortillas have become so popular that the fast food industry has included them as staple items in their menus, and several restaurant chains now exist wherein the tortilla is the staple bread on the menu.

Unfortunately, conventional containers for conventional baked products are ill-suited to carry flour or corn tortilla baked products. As those of ordinary skill in the art of the present invention can appreciate, flour and corn tortillas are relatively heavy, dense baked goods. They are not yeast risen, so they remain relatively flat and flexible. As such, they can be easily stored (one on top of each other), and are commonly sold in packages that weigh as much as five, six or more pounds per bag. Because they are soft and flexible, flour and corn tortillas are easily susceptible to damage. For example, if the flour or corn tortilla package (which generally is only a thin plastic bag) is placed on an indented or protruding surface, the bottom most tortillas most likely will become damaged, with the mark of the indentation or projection transferred to at least several of the bottom most tortillas. While mostly aesthetically unattractive, if the projections or indentation markings are severe enough, they can affect the usefulness of the tortilla by damaging them, or making them weaker at the point of indentation or projection. Consumers, will tend avoid such damaged products. Conventional baked good containers, therefore, with their open ribbed bottoms, are particularly ill-suited for the transportation and/or storage of flour or corn tortillas. Still further, such containers are typically not nearly strong enough to safely carry all the corn or flour tortillas that can fit within them. Therefore, even if one could avoid the problem of damaging or marking the tortillas, use of the conventional container that are designed to carry much lighter yeast-risen baked goods would be inefficient and therefore costly.

Thus, a need exists for a container capable of carrying baked flour and corn tortillas that has the required weight-carrying capacity and will not harm and/or mark the baked flour and corn tortillas.

SUMMARY OF THE INVENTION

It is therefore a general aspect of the invention to provide a container that will obviate or minimize problems of the type previously described. According to a first aspect of the present invention, a container for shipping and storage of packages of baked goods is provided, comprising: a front wall, a rear wall, a left side wall, a right side wall, and a base, wherein, each of the front wall, rear wall, left side wall, and right side wall are substantially orthogonal to the base; and a plurality of base projections located on an upper surface of the base of the container, wherein the base projections are configured to position two or more packages of baked goods such that the packages of baked goods are substantially prevented from sliding about an interior portion of the container. According to the first aspect, each of the plurality of base projections comprises: a plurality of angled surfaces, rising from the upper surface of the base of the container; and an upper surface, wherein the upper surface is joined together with an upper portion of each of the plurality of angled surfaces. According to the first aspect, each of the plurality of angled surfaces comprises: a curved surface, wherein a radius of curvature of each the curved surfaces is substantially similar to a radius of curvature of the package of baked goods. Still further according to the first aspect, the radius of curvature of each of the curved surfaces is substantially similar to a radius of curvature of the baked goods.

Furthermore, according to the first aspect of the present invention, the upper surface comprises: a plurality of cross pieces, wherein a first cross piece is fixedly attached to a first angled surface and a second oppositely located angled surface, and a second cross piece is fixedly attached to a third angled surface and a fourth oppositely located angled surface. The plurality of cross pieces forms a grid with a plurality of openings according to the first aspect. According to the first aspect, the plurality of angled surfaces comprises four angled surfaces, and a height of each of the base projections is between about 20 percent and about 40 percent of an interior height of the walls of the container. According to the first aspect, a height of each of the base projections is between about 25 percent and about 35 percent of an interior height of the walls of the container, and still further according to the first aspect, the height of each of the base projections is about 33.3 percent of an interior height of the walls of the container. According to the first aspect, the plurality of base projections are configured locate at least six separate stacks of packages of baked goods, such that the at least six separate stacks of packages of baked goods are substantially prevented from sliding about an interior portion of the container. And still further according to the first aspect, the plurality of base projections comprises two base projections, and base projections are substantially shaped like a pyramid. According to the first aspect, the base projections are substantially shaped like a column, and wherein the substantially column shaped base projections are tapered such that each is narrower at an upper portion than at a base portion. According to the first aspect, the substantially column shaped base projections are substantially circular. According to the first aspect, the substantially column shaped base projections are substantially square. Still further according to the first aspect, the substantially column shaped base projections are substantially rectangular. According to the first aspect, each of the base projections comprise an opening at an upper location of each of the base projections, such that each of the base projections of an upper container is configured to ventilate heat from a lower container that accumulates in the interior portion of the lower container after the container has been loaded with baked goods.

According to a second aspect of the present invention, a container for shipping and storage of packages of baked goods is provided, comprising: a front wall, a rear wall, a left side wall, a right side wall, and a base, wherein, each of the front wall, rear wall, left side wall, and right side wall are substantially orthogonal to the base; a rim surface located on an uppermost portion of each of the front wall, right side wall, rear wall, and left side wall; a plurality of stacking feet, wherein each of the plurality stacking feet includes a lowermost portion configured to be positioned upon a substantially identical lower container in a 180° stacking orientation, and wherein the lowermost portion includes a stacking foot recess; and a plurality of rim surface recesses, wherein each of the plurality of rim surface recesses includes a rim surface recess projection that rises substantially orthogonally from a lowermost surface of the corresponding rim surface recess, wherein each of the rim surface recess projections of the lower container is configured to be positioned within each of a respective stacking foot recess of each of the plurality of stacking feet when an upper container is stacked on a lower container in a 180° stacking orientation, and further wherein, each of the rim surface recess projections is further configured to substantially prevent shifting and movement of each of the respective corresponding stacking feet of the upper container positioned on each of the rim surface recess projections of the lower container, thereby substantially preventing shifting and movement of the upper container.

Still further according to the second aspect, each of the plurality of rim surface recesses is substantially rectangular. According to the second aspect each of the plurality of rim surface recesses is substantially square. According to the second aspect, each of the rim surface recess projections is substantially U-shaped. According to the second aspect each of the rim surface recess projections is substantially "["-shaped. According to the second aspect, each of the plurality of stacking foot recesses is substantially rectangular shaped. According to the second aspect each of the plurality of stacking foot recesses is substantially square shaped.

BRIEF DESCRIPTION OF THE DRAWINGS

The novel features and advantages of the present invention will best be understood by reference to the detailed description of the preferred embodiments that follows, when read in conjunction with the accompanying drawings, in which.

DETAILED DESCRIPTION OF THE PREFERRED EMBODIMENTS

Figure 1:
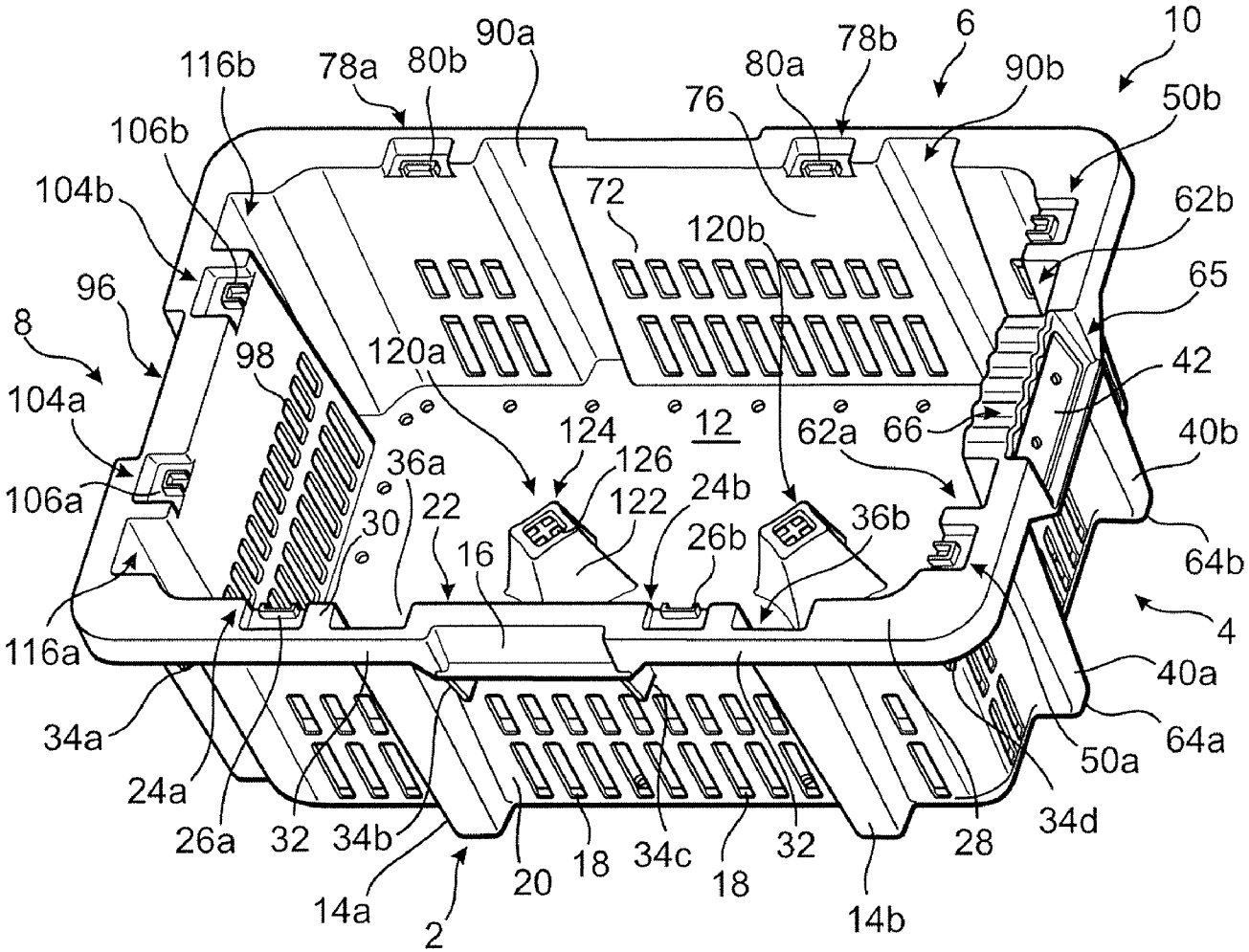
FIG. 1 illustrates a top perspective view of a container according to an embodiment of the present invention.

The various features of the preferred embodiments will now be described with reference to the drawing figures, in which like parts are identified with the same reference characters. The following description of the presently contemplated best mode of practicing the invention is not to be taken in a limiting sense, but is provided merely for the purpose of describing the general principles of the invention.

I. Introduction—Container 10

Container 10 comprises a front wall 2, right side wall 4, rear wall 6, left side wall 8, and a base 12. According to a preferred embodiment of the present invention, container 10 can carry baked products that are generally heavier and more easily damaged than most yeast-risen baked goods. The features of container 10 are substantially robust, and according to a preferred embodiment of the present invention, container 10 can carry baked goods that weigh in total as much as 30-50 pounds. According to a preferred embodiment of the present invention, container 10 carries flour or corn tortillas. Container 10 comprises eight substantial rigid stacking feet that are substantially as tall as the height of the entire container 10. In a 0° nesting orientation, the stacking feet fit within stacking wells that are fabricated within the walls of container 10; in a 180° stacking orientation, the bottom most portion of each of the stacking feet of container 10 fits within a rectangular shaped well or recess that is located on the top portion of each respective wall, and further each stacking well or recess contains a substantially U-shaped (or "["shaped) projection that positions and substantially prevents slipping between the stacking feet of the upper container 10' and the lower container 10. In the interior portion of container 10, on the upper surface of base 12, are located at least two cones, 120*a, b* according to a preferred embodiment of the present invention. The two cones 120*a, b* facilitate positioning the packages of baked goods that, according to an embodiment of the present invention, comprise flour or corn tortillas. As those of ordinary skill in the art of the present invention can appreciate, however, container 10 is not limited in any manner whatsoever to the transporting, storing and/or shipping of flour or corn tortillas. Many other different types of products and/or baked goods (including meat products) can be transported, stored and/or shipped using container 10. Each of these features, as well as additional ones, shall now be described in greater detail.

II. Container 10

A. Front Wall 2

Figure 3:
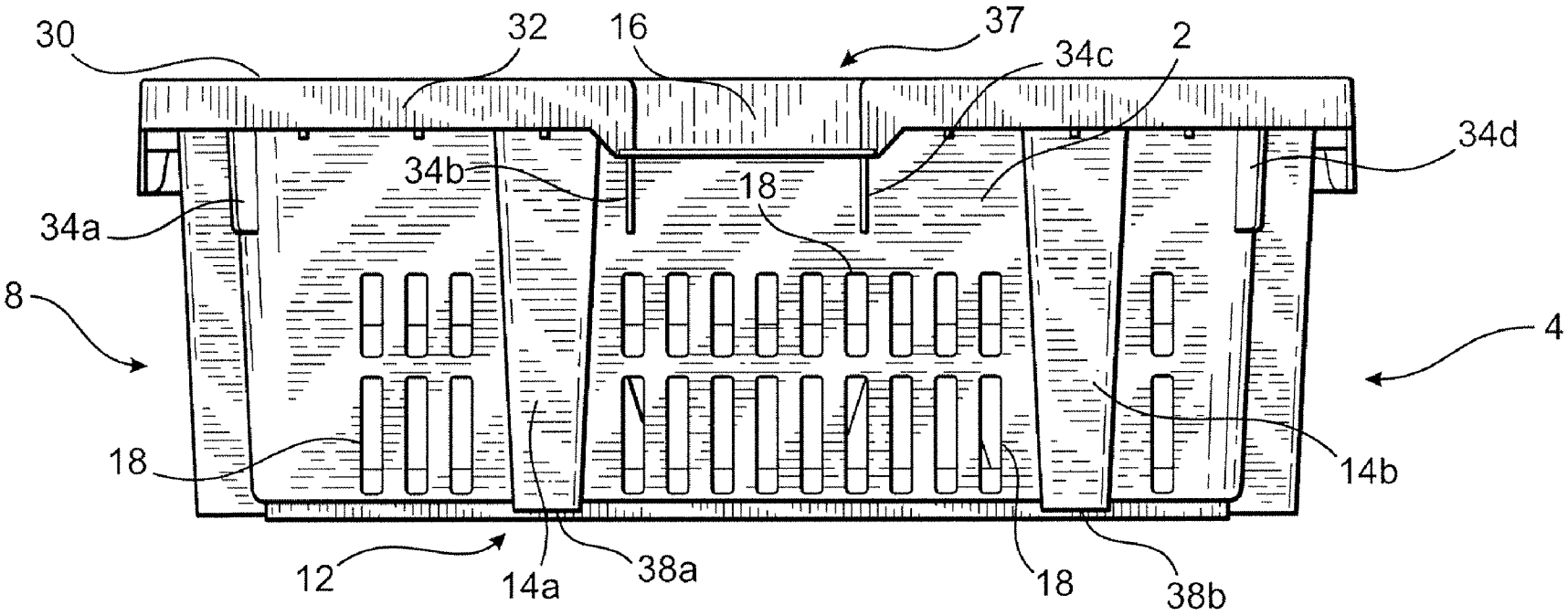
FIG. 3 illustrates a front view of the container shown in FIG. 1.

As shown in FIGS. 1 and 3, front wall 2 extends substantially vertically and substantially orthogonally from base 12 of container 10, and is substantially orthogonal to left and right side walls 8, and 4. Front wall 2 is substantially parallel to rear wall 6. Front wall 2 includes front wall outer surface 20, front wall inner surface 22, front wall rim 28, vertical nesting support plates 34*a-d*, and front wall handle 37. Front wall 2 further includes a plurality of ventilation holes 18, left and right front wall stacking feet 14*a, b*, as well as left and right front wall 180° stacking recesses 24*a, b*, and left and right front wall 0° nesting feet channels 36*a, b*.

Front wall rim 28 is located at a top or upper portion of front wall 2, and comprises a vertical and horizontal portion. The rim runs continuously around container 10, although it is identified separately for each of the four wall portions. Front wall rim 28 comprises front wall rim vertical portion 32 and front wall rim horizontal portion 30. Front wall vertical rim portion 32 is substantial co-planar with front wall 2, and orthogonal to front wall rim horizontal portion 30, which is itself substantially horizontal and substantially parallel to base 12. According to a preferred embodiment of the present invention, front wall rim 28 (and its counterparts for the remaining three walls) adds strength to container 10 because of its structure. Front wall rim 28 includes, as described above, front wall rim horizontal portion 30 and front wall rim vertical portion 32, and a portion of front wall 2 itself. Connecting all three portions together are a plurality of spaced-apart vertical plates of which vertical nesting support plates 34*a-d* are part of this plurality. According to an exemplary embodiment of the present invention, the vertical plates add substantial strength and rigidity to front wall rim 28, and hence container 10. According to a preferred embodiment of the present invention, front wall rim 28 provides an operator with a substantially more stable gripping area with which to pick up container 10 that is heavily loaded with baked goods, including, preferably, tortillas. Front wall rim 28, according to an exemplary embodiment of the present invention, can be generally described as a hollow, substantially rectangular tube-like shape, with the advantage of trusses (i.e., the spaced apart vertical plates) to provide additional strength.

Figure 10:
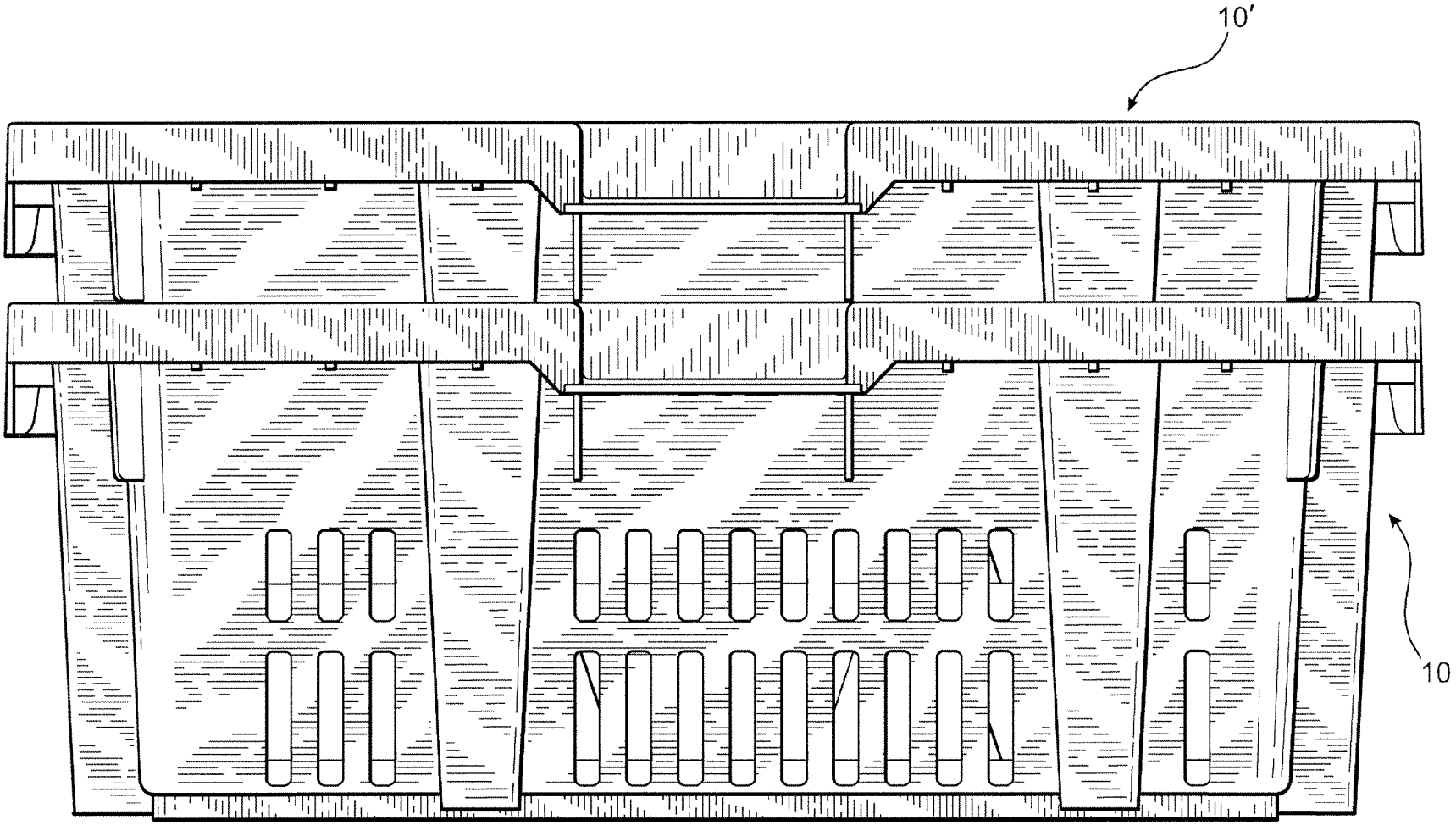
FIG. 10 illustrates a front view of an upper container substantially fully nested within a lower container in a 0° nesting orientation according to an embodiment of the present invention.

Vertical nesting support plates 34*a-d*, as shown in FIGS. 1-6 and 10-15, assist in preventing upper container 10' from becoming wedged too tightly within lower container 10 when the containers 10, 10' are placed in a 0° nesting orientation. Vertical nesting support plates 34*a-d* are substantially vertical, relatively thin plates that extend downwardly from underneath front wall rim 28. As shown in FIG. 10, vertical nesting support plates 34*a'-d'* of upper container 10' rest upon front wall rim horizontal portion 30. If ten, twenty, or even more containers 10 are nested in a 0° nesting orientation for transport and/or storage, vertical nest support plates 34*a-d* substantially prevent upper containers 10' from becoming wedged too tightly into lower containers 10.

According to a preferred embodiment of the present invention, each of left and right front wall stacking feet 14*a, b* are integrally formed by front wall 2, and are substantially trapezoidal in shape. That is, the top portion of each of front wall stacking feet 14*a, b* is slightly wider than a bottom portion of the stacking foot. According to a preferred embodiment of the present invention, left and right front wall nesting feet channels 36*a, b* are co-formed by left and right front wall stacking feet 14*a, b*, and are therefore similarly shaped. By designing the top or upper portion of left and right front wall stacking feet 14*a, b*, and left and right front wall 0° nesting feet channels 36*a, b* to be wider than they are at a bottom or lower portion, a similar upper container 10' can be readily and easily substantially nested in a 0° nesting orientation in regard to lower container 10. Front wall 2 further comprises left and right front wall 180° stacking recesses 24*a, b*, each of which contain left and right front wall 180° stacking recess projections 26*a, b*. In the 180° stacking orientation, when an upper similar container 10' is rotated 180° with respect to lower container 10, and then placed upon lower container 10, such that rear wall 6' of upper container 10' faces the same direction as front wall 2 of lower container 10, the bottoms of each of right and left rear wall stacking feet 68*b*, a fits within respective left and right front wall 180° stacking recesses 24*a, b*. 0° Nesting and 180° stacking is discussed in greater detail infra.

B. Right Side Wall 4

Figure 6:
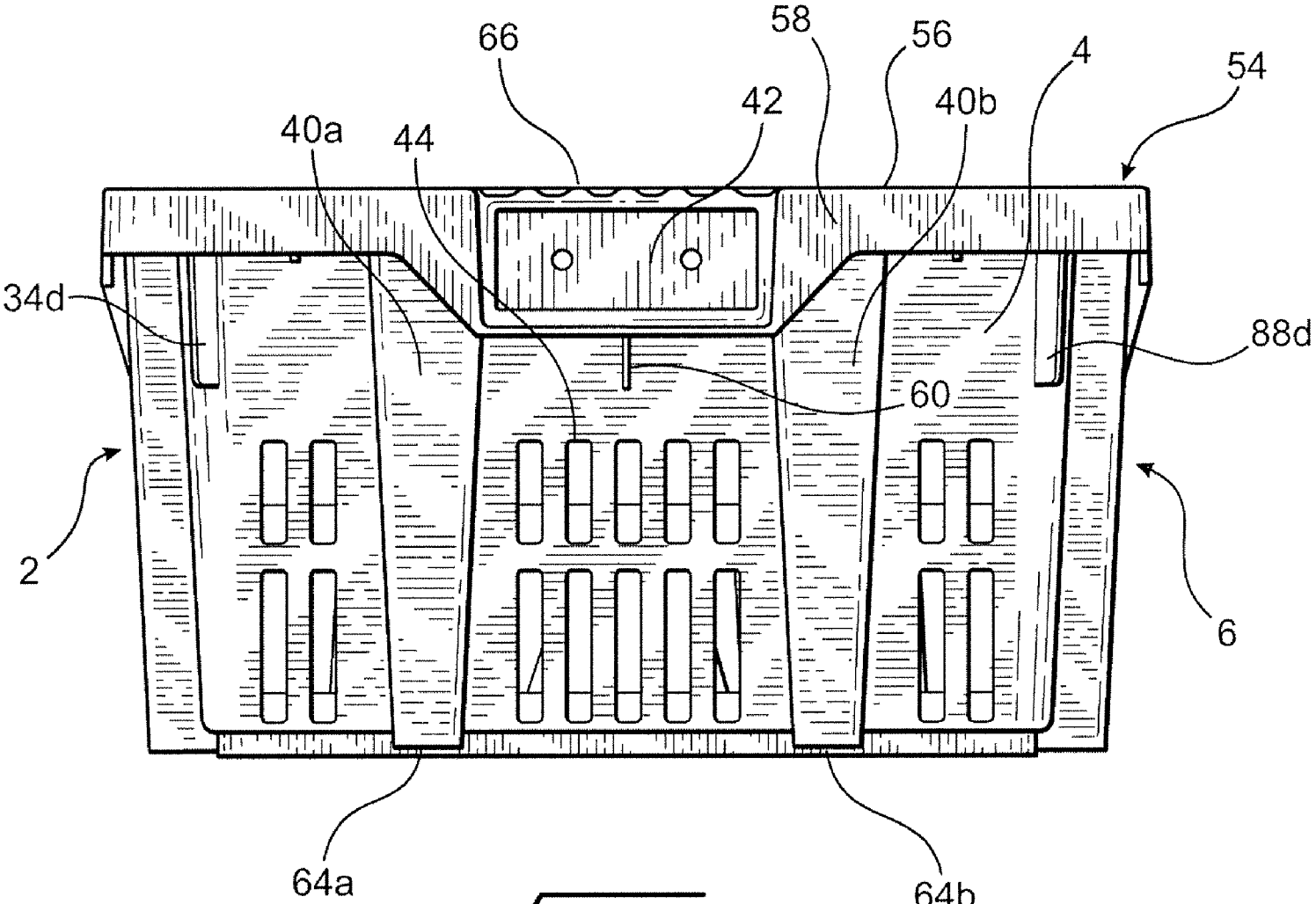
FIG. 6 illustrates a right side view of the container shown in FIG. 1.

As shown in FIGS. 1 and 6, right side wall 4 preferably extends substantially vertically and substantially orthogonally from base 12 of container 10, and is substantially orthogonal to front left side wall 8 and rear wall 6. Right side wall 4 is substantially parallel to left side wall 6. Right side wall 4 includes right side wall outer surface 46, right side inner surface 48, right side wall rim 54, vertical nesting support plate 60 and right side wall handle 42. Right side wall handle 42 includes means (holes) for mounting RFID tags, the use of which is well known to those of ordinary skill in the art of the present invention. According to a preferred embodiment of the present invention, right side wall handle 42 further includes scalloped top portion 66, which allows operators to easily identify the orientation of container 10. Right side wall 4 further includes a plurality of ventilation holes 44, front and rear right side wall stacking feet 40*a, b*, as well as front and rear right side wall 180° stacking recesses 50*a, b*, and front and rear right side wall 0° nesting feet channels 62*a, b*.

Right side wall rim 54 is located at a top or upper portion of right side wall 4, and comprises a vertical and horizontal portion. The rim runs continuously around container 10, although, as mentioned supra, it is identified separately for each of the four wall portions. Right side wall rim 54 comprises right side wall rim vertical portion 58 and right side wall rim horizontal portion 56. According to a preferred embodiment of the present invention, right side wall vertical rim portion 58 is substantial planar to right side wall 4, and orthogonal to right side wall rim horizontal portion 56, which is itself substantially horizontal, and substantially parallel to base 12. Right side wall rim 54 (and its counterparts for the remaining three walls) add strength to container 10 because of its structure. Right side wall rim 54 includes, as described above, right side wall rim horizontal portion 56 and right side wall rim vertical portion 58, and a portion of right side wall 4 itself. Connecting all three portions together are a plurality of spaced-apart vertical plates of which vertical nesting support plate 60 is part of this plurality. According to an exemplary embodiment of the present invention, vertical plates add substantial strength and rigidity to right side wall rim 54, and hence container 10. According to a preferred embodiment of the present invention, right side wall rim 54 provides an operator with a substantially more stable gripping area with which to pick up container 10 that is heavily loaded with baked goods, including tortillas. According to a preferred embodiment of the present invention, right side wall rim 54 can be generally described as a hollow, substantially rectangular tube-like shape, with the advantage of trusses (the spaced apart vertical plates) to provide additional strength.

According to a preferred embodiment of the present invention, vertical nesting support plate 60, as shown in FIG. 6, assists in preventing upper container 10' from becoming wedged too tightly within lower container 10 when the containers 10, 10" are placed in a 0° nesting orientation. Vertical nesting support plate 60 is a substantially vertical, relatively thin plate that extends downwardly from underneath right side wall rim 54. The discussion, supra, in regard to front wall vertical nesting support plates 34*a-d*, applies equally as well to vertical nesting support plate 60, and shall not be repeated for the purpose of clarity.

According to a preferred embodiment of the present invention, each of front and rear right side wall stacking feet 40*a, b* are integrally formed by right side wall 4, and are substantially trapezoidal in shape. That is, the top portion of each of front and rear right side wall stacking feet 40*a, b* is slightly wider than a bottom portion of the stacking foot. According to an exemplary embodiment of the present invention, front and rear right side wall stacking feet channels 62*a, b* are co-formed by front and rear right side wall stacking feet 40*a, b*, and are therefore similarly shaped. By designing the top or upper portion of front and rear right side wall stacking feet 40*a, b* and front and rear front wall stacking feet channels 62*a, b* to be wider than they are at a bottom or lower portion, a similar upper container 10' can be readily and easily substantially nested in a 0° nesting orientation in regard to lower container 10. Right side wall 4 further comprises front and rear right side wall 180° stacking recesses 50*a, b*, each of which contain front and rear right side wall 180° stacking recess projections 52*a, b*. In the 180° stacking orientation, when an upper similar container 10' is rotated 180° with respect to lower container 10, and then placed upon lower container 10, such that left side wall 8' of upper container 10' faces the same direction as right side wall 4 of lower container 10, the bottoms of each of rear and front left side wall stacking feet 118*b*, a fits within respective front and rear right side wall 180° stacking recesses 50*a, b*. 0° Nesting and 180° stacking is discussed in greater detail infra.

C. Rear Wall 6

Figure 4:
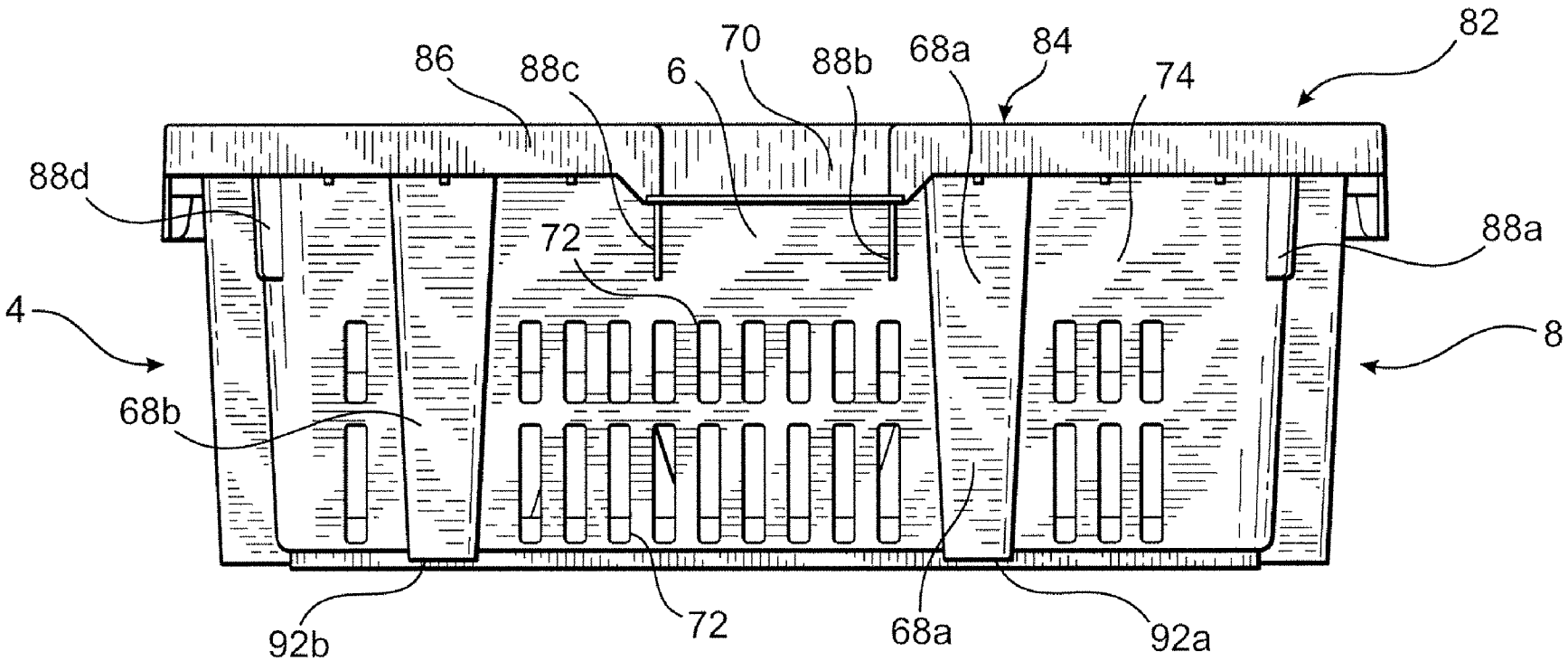
FIG. 4 illustrates a rear view of the container shown in FIG. 1.

As shown in FIGS. 1 and 4, rear wall 6 extends substantially vertically and substantially orthogonally from base 12 of container 10, and is substantially orthogonal to left and right side walls 8, and 4. Rear wall 6 is substantially parallel to front wall 2. Rear wall 6 includes rear wall outer surface 74, rear wall inner surface 76, rear wall rim 82, vertical nesting support plates 88*a-d*, and rear wall handle 70. Rear wall 6 further includes a plurality of ventilation holes 72, left and right rear wall stacking feet 68*a, b*, as well as left and right rear wall 180° stacking recesses 78*a, b*, and left and right rear wall 0° nesting feet channels 90*a, b*.

Rear wall rim 82 is located at a top or upper portion of rear wall 6, and comprises a vertical and horizontal portion. Rear wall rim 82 comprises rear wall rim vertical portion 86 and rear wall rim horizontal portion 84. Rear wall vertical rim portion 82 is substantial planar to rear wall 6, and orthogonal to rear wall rim horizontal portion 84, which is itself substantially horizontal and substantially parallel to base 12. According to a preferred embodiment of the present invention, rear wall rim 82 (and its counterparts for the remaining three walls) adds strength to container 10 because of its structure. According to a preferred embodiment of the present invention, rear wall rim 82 includes, as described above, rear wall rim horizontal portion 84 and rear wall rim vertical portion 86, and a portion of rear wall 6 itself. Connecting all three portions together are a plurality of spaced-apart vertical plates of which vertical nesting support plates 88*a-d* are part of this plurality. According to an exemplary embodiment of the present invention, the vertical plates add substantial strength and rigidity to rear wall rim 82, and hence container 10. According to a preferred embodiment of the present invention, rear wall rim 82 provides an operator with a substantially more stable gripping area with which to pick up container 10 that is heavily loaded with baked goods, including, preferably, tortillas. According to a preferred embodiment of the present invention, rear wall rim 82 can be generally described as a hollow, substantially rectangular tube-like shape, with the advantage of trusses (the spaced apart vertical plates) to provide additional strength.

Figure 5:
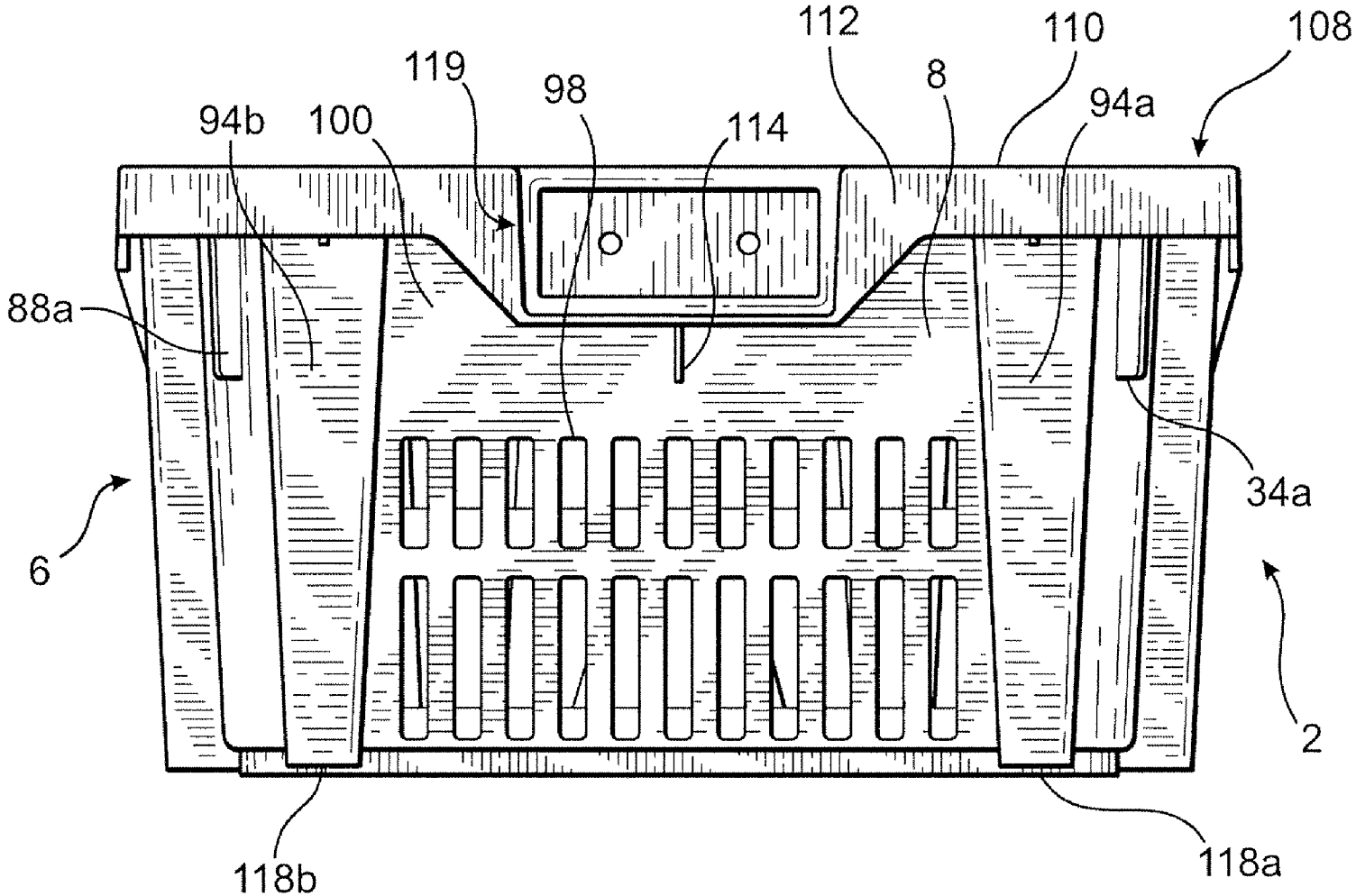
FIG. 5 illustrates a left side view of the container shown in FIG. 1.

Vertical nesting support plates 88*a-d*, as shown in FIGS. 4-6, assist in preventing upper container 10' from becoming wedged too tightly within lower container 10 when the containers 10, 10" are placed in a 0° nesting orientation. Vertical nesting support plates 88*a-d* are substantially vertical, relatively thin plates that extend downwardly from underneath rear wall rim 82. The discussion supra, in regard to front wall vertical nesting support plates 34*a-d*, applies equally as well to vertical nesting support plates 88*a-d*, and shall not be repeated for the purpose of clarity.

According to a preferred embodiment of the present invention, each of left and right rear wall stacking feet 68*a, b* are integrally formed by rear wall 6, and are substantially trapezoidal in shape. That is, the top portion of each of rear wall stacking feet 68*a, b* is slightly wider than a bottom portion of the stacking foot. According to a preferred embodiment of the present invention, left and right rear wall 0° nesting feet channels 90*a, b* are co-formed by left and right rear wall stacking feet 68*a, b*, and are therefore similarly shaped. By designing the top or upper portion of left and right rear wall stacking feet 68*a, b*, and left and right rear wall 0° nesting feet channels 90*a, b* to be wider than they are at a bottom or lower portion, a similar upper container 10' can be readily and easily substantially nested in a 0° nesting orientation in regard to lower container 10. Rear wall 6 further comprises left and right rear wall 180° stacking recesses 78*a, b*, each of which contain left and right rear wall 180° stacking recess projections 80*a,b*. In the 180° stacking orientation, when an upper similar container 10' is rotated 180° with respect to lower container 10, and then placed upon lower container 10, such that front wall 2' of upper container 10' faces the same direction as rear wall 6 of lower container 10, the bottoms of each of right and left front wall stacking feet 14*b*, a fits within respective left and right rear wall 180° stacking recesses 78*a, b*. 0° Nesting and 180° stacking is discussed in greater detail infra.

D. Left Side Wall 8

As shown in FIGS. 1 and 5, left side wall 8 extends preferably substantially vertically and substantially orthogonally from base 12 of container 10, and is substantially orthogonal to front and rear walls 2, and 6. Left side wall is substantially parallel to right side wall 4. Left side wall 8 includes left side wall outer surface 100, left side inner surface 102, left side wall rim 108, vertical nesting support plate 114 and left side wall handle 119. Left side wall handle 119 includes means (holes) for mounting RFID tags, the use of which is well known to those of ordinary skill in the art of the present invention. Left side wall 8 further includes a plurality of ventilation holes 98, front and rear left side wall stacking feet 94*a, b*, as well as front and rear left side wall 180° stacking recesses 104*a, b*, and front and rear left side wall 0° nesting feet channels 116*a,b*.

Left side wall rim 108 is located at a top or upper portion of left side wall 8, and comprises a vertical and horizontal portion. The rim runs continuously around container 10, although, as mentioned supra, it is identified separately for each of the four wall portions. Left side wall rim 108 comprises left side wall rim vertical portion 112 and left side wall rim horizontal portion 110. According to a preferred embodiment of the present invention, left side wall rim vertical portion 112 is substantial planar to left side wall 8, and orthogonal to left side wall rim horizontal portion 110, which is itself substantially horizontal, and substantially parallel to base 12. Left side wall rim 108 (and its counterparts for the remaining three walls) add strength to container 10 because of its structure. Left side wall rim 108 includes, as described above, left side wall rim horizontal portion 110 and left side wall rim vertical portion 112, and a portion of left side wall 8 itself.

Connecting all three portions together are a plurality of spaced-apart vertical plates of which vertical nesting support plate 114 is part of this plurality. According to an exemplary embodiment of the present invention, the vertical plates add substantial strength and rigidity to left side wall rim 108, and hence container 10. According to a preferred embodiment of the present invention, left side wall rim 108 provides an operator with a substantially more stable gripping area with which to pick up container 10 that is heavily loaded with baked goods, including tortillas. According to a preferred embodiment of the present invention, left side wall rim 108 can be generally described as a hollow, substantially rectangular tube-like shape, with the advantage of trusses (the spaced apart vertical plates) to provide additional strength.

Vertical nesting support plate 114, as shown in FIG. 5, assists in preventing upper container 10' from becoming wedged too tightly within lower container 10 when the containers 10, 10" are placed in a 0° nesting orientation. Vertical nesting support plate 114 is a substantially vertical, relatively thin plate that extends downwardly from underneath left wall rim 108. The discussion supra, in regard to front wall vertical nesting support plates 34*a-d*, applies equally as well to vertical nesting support plate 114, and shall not be repeated for the purpose of clarity.

According to a preferred embodiment of the present invention, each of front and rear left side wall stacking feet 94*a, b* are integrally formed by left side wall 8, and are substantially trapezoidal in shape. That is, the top portion of each of front and rear left side wall nesting feet 94*a, b* is slightly wider than a bottom portion of the stacking foot. According to a preferred embodiment of the present invention, front and rear left side wall 0° nesting feet channels 116*a, b* are co-formed by front and rear left side wall stacking feet 94*a, b*, and are therefore similarly shaped. By designing the top or upper portion of front and rear left side wall stacking feet 94*a, b*, and front and rear left wall 0° nesting feet channels 116*a, b* to be wider than they are at a bottom or lower portion, a similar upper container 10' can be readily and easily substantially nested in a 0° nesting orientation in regard to lower container 10. Left side wall 8 further comprises front and rear left side wall 180° stacking recesses 104*a, b*, each of which contain front and rear left side wall 180° stacking recess projections 106*a, b*. In the 180° stacking orientation, when an upper similar container 10' is rotated 180° with respect to lower container 10, and then placed upon lower container 10, such that right side wall 4' of upper container 10' faces the same direction as left side wall 8 of lower container 10, the bottoms of each of rear and front right side wall stacking feet 40*b*, a fits within respective front and rear left side wall 180° stacking recesses 104*a, b*. 0° Nesting and 180° stacking is discussed in greater detail infra.

E. Base 12

Figure 2:
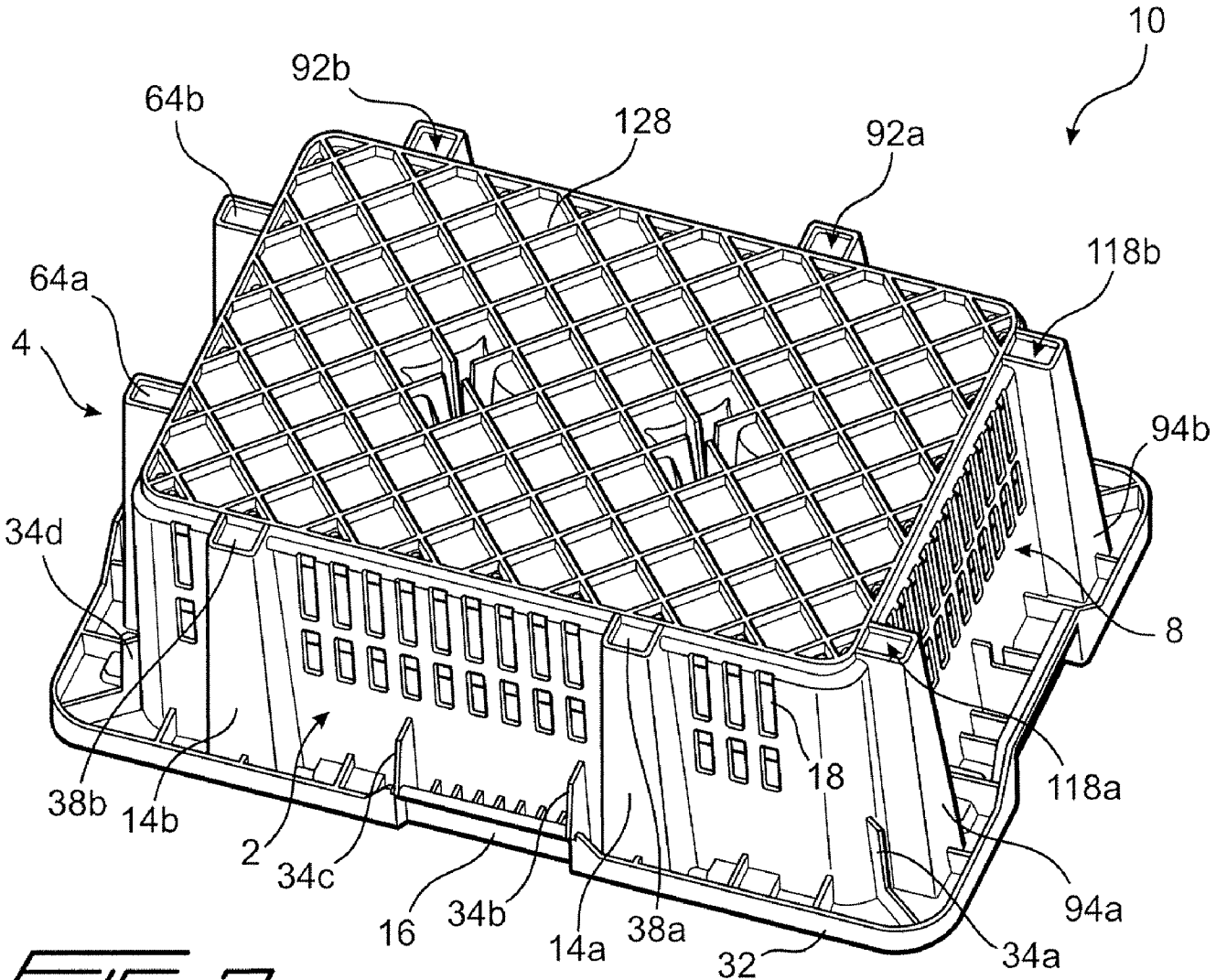
FIG. 2 illustrates a bottom perspective view of the container shown in FIG. 1.
Figure 7:
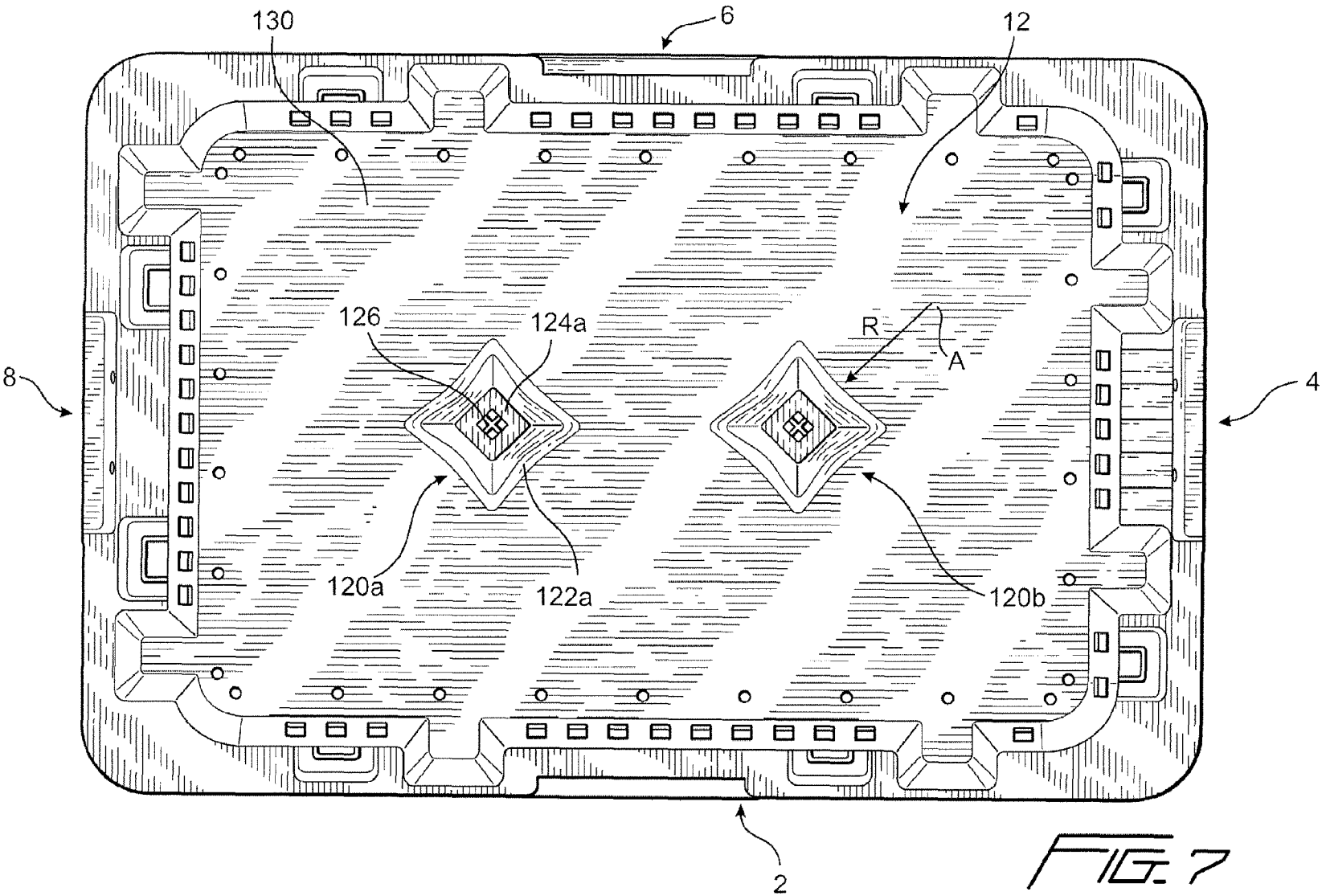
FIG. 7 illustrates a top view of the container shown in FIG. 1.
Figure 8:
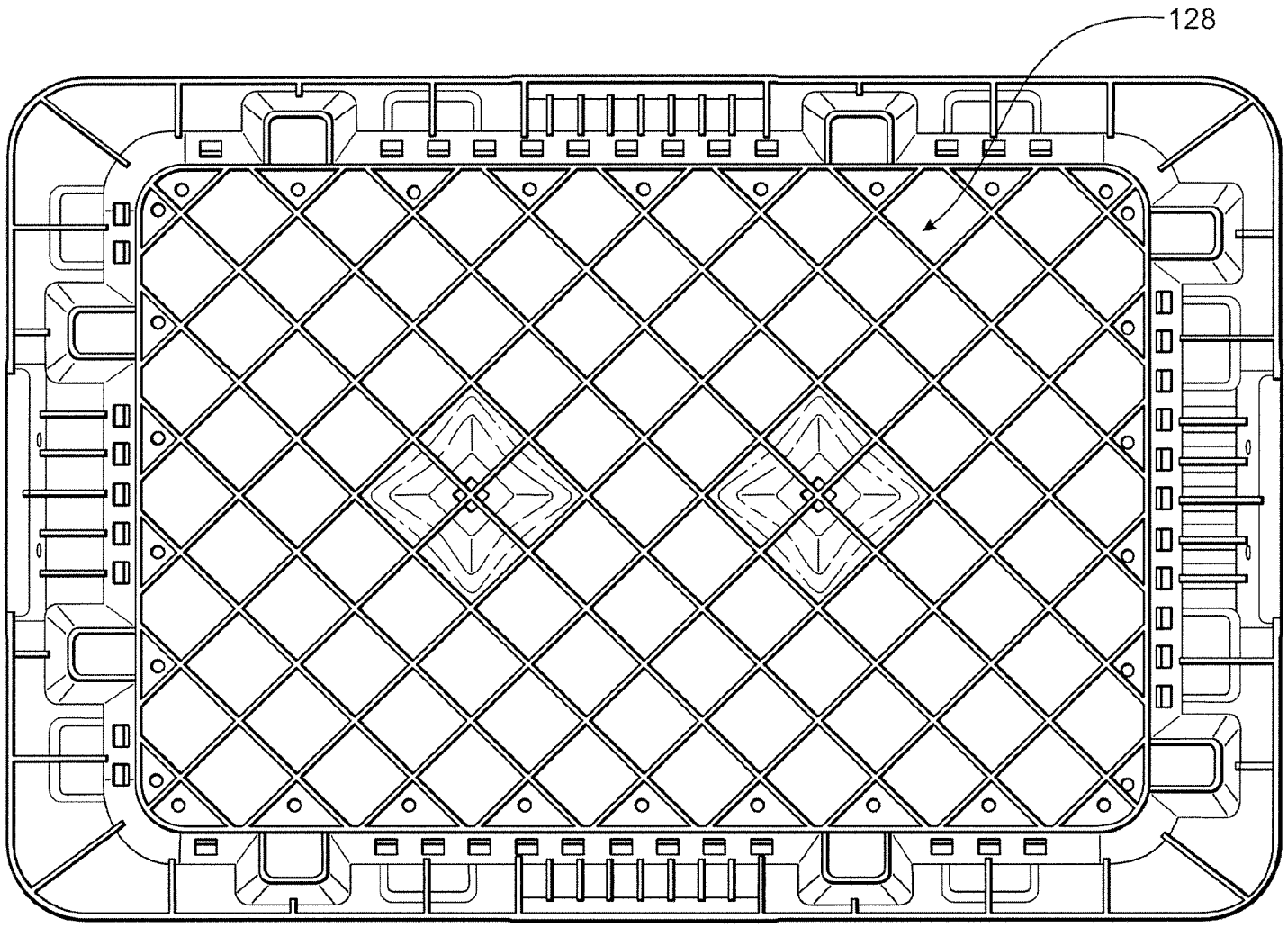
FIG. 8 illustrates a bottom view of the container shown in FIG. 1.
Figure 16:
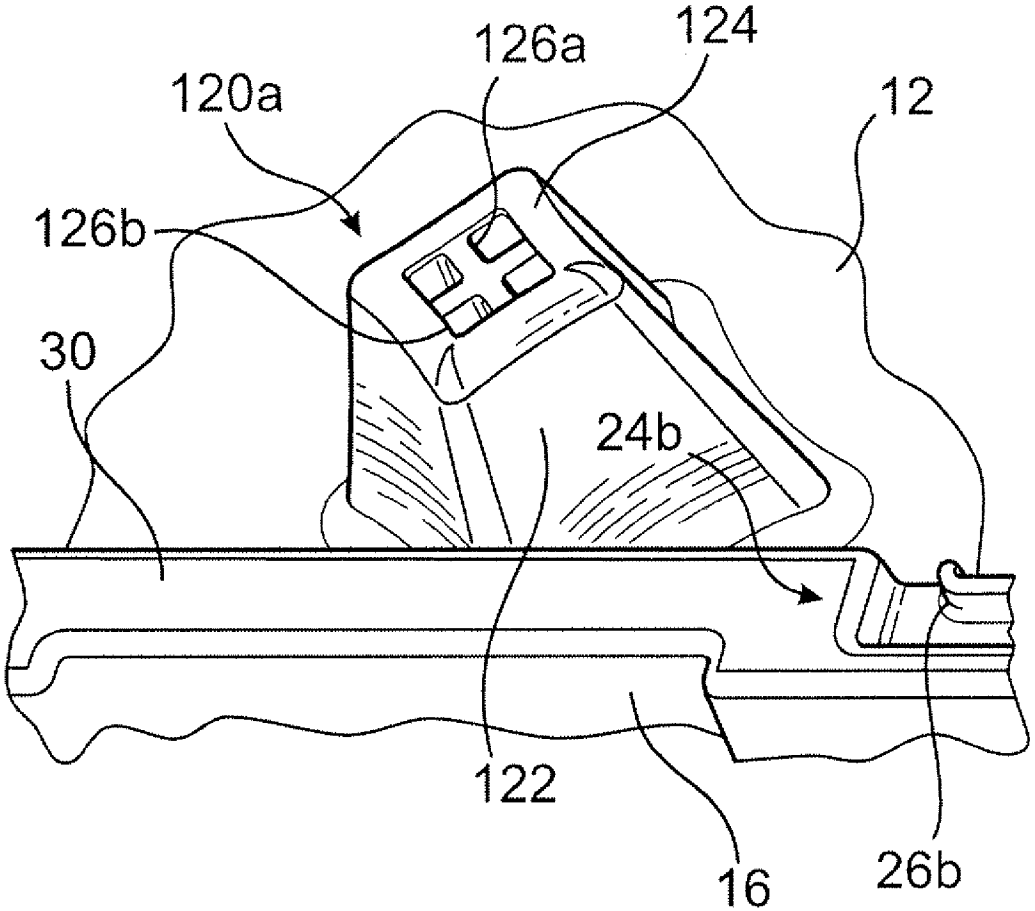
FIG. 16 illustrates a close-up perspective view of a cone in the container shown in FIG. 1 according to an embodiment of the present invention.

Referring to FIGS. 1, 2 and 7, base 12 is preferably substantially orthogonal to left and right side walls 8, 4 and front and rear walls 2, 6. Base 12 includes a substantially flat upper surface 130, and a ribbed lower surface 128. Further provided on upper surface 130 of base 12 are left and right cones 120*a, b*. FIG. 16 illustrates a close-up perspective view of cone 120*a* according to an exemplary embodiment of the present invention. Left cone 120*a* (and right cone 120*b*) comprises a plurality of sloped curved surfaces 122. According to a preferred embodiment of the present invention, cones 120*a, b* are substantially shaped like a truncated pyramid; that is, each of cones 120*a, b* is four sided, with sides that rise upwardly and slope inwardly and a base portion that is larger in perimeter than the top, generally flat upper surface 124. Generally flat upper surface 124 comprises a plurality of cone crosspieces 126; according to an exemplary embodiment of the present invention, a first cone cross piece 126*a* is connected to an upper portion of first sloped curved surface 122*a* and to a second sloped curved surface 122*b* directly opposite that of first sloped curved surface 122*a*. A second cone cross piece 126*b* is connected to a third sloped curved surface 122*c* and fourth sloped curved surface 122*d*, directly opposite that of third sloped curved surface 122*c*. A grid is thereby formed by the intersecting of cone cross pieces 126*a, b*, forming a plurality of openings, discussed in detail infra.

As opposed to a pyramid, left and right cones 120*a, b*, according to an exemplary embodiment of the present invention, are substantially flat topped, with an upper surface 124 that is substantially parallel to base 12. Left and right cones 120*a, b* can also be referred to as base projections 120*a, b*, or projections 120*a, b*. According to a preferred embodiment of the present invention, each of sloped curved surfaces 122 provide a structural interface whereby baked goods, preferably packages of tortillas, are kept substantially separated from each other and substantially prevented from sliding about the interior portion of container 10. Cone or tapered substantially pyramid shaped structure projections (base projections) 120*a, b* is used because it allows operators to more easily insert packaged of baked goods into the interior of container 10. According to an exemplary embodiment of the present invention, operators in the baking industry can find it easier to insert packages of baked tortillas into the interior portion of the container 10 because base projections 120*a, b* act as a lead to the packages of baked goods as placed in the interior portion of container 10. However, ease of loading container 10 through use of base projections 120*a, b* is not limited to tortilla products, as nearly any other type of baked good or agricultural or meat product can be more easily loaded into container 10 because of base projections 120*a, b*.

According to an exemplary embodiment of the present invention, base projections 120*a, b* can also be shaped like a column. According to a preferred embodiment of the present invention, base projections 120*a, b* can also be substantially column shaped, substantially round, substantially square, substantially oval, or substantially rectangular, and can be substantially tapered or not.

According to an exemplary embodiment of the present invention, each of cones 120*a, b* includes a plurality of sloped curved surfaces 122 wherein the radius of curvature of each of the sloped curved surfaces 122 is substantially similar to the radius of curvature of the tortillas. According to a preferred embodiment of the present invention, tortillas are packaged in soft, relatively thin plastic bags, wherein the packages generally conform to the shape of the baked tortilla product. By matching the radius of curvature of the sloped curved surface 122 to the radius of curvature of the tortillas, the tortillas and tortilla packages are substantially securely fixed in place. As one of ordinary skill in the art of the present invention can appreciate, the radius of curvature of the sloped curved surfaces 122 is not constant because of the taper of the sloped curved surface 122; that is, the radius of curvature of sloped curved surfaces 122 is a first value at the interface between flat upper surface 130 of base 12 and each of the sloped curved surfaces 122, and increases to a final value at the uppermost portion of the sloped curved surfaces 122. According to an exemplary embodiment of the present invention the radius of curvature of sloped curved surfaces 122 at the base interface between flat upper surface 130 of base 12 and sloped curved surfaces 122 ranges from about 2.25" to about 4.25". According to a preferred embodiment of the present invention, the radius of curvature at the base interface between flat upper surface 130 of base 12 and sloped curved surfaces 122 is about 3.25". According to further exemplary non-limiting embodiments of the present invention, the radius of curvature at the base interface between flat upper surface 130 of base 12 and sloped curved surfaces 122 can range from between about 2" to about 10".

Because baked goods in general, and tortillas in particular, are soft malleable goods, flat upper surface 130 of base 12 is substantially smooth, flat and substantially free of any markings, indentations, and/or projections, with the exception of several drain holes as shown in FIG. 1. Referring to FIG. 7, it can be seen that the placement of cones (or base projections) 120*a, b* allow for stacking of at least six different stacks of tortilla packages according to a preferred embodiment of the present invention. As one of ordinary skill in the art can appreciate, operators can load containers 10 just after the baking process has been completed and packaging has occurred. Therefore, the packages of baked goods are usually fairly warm when loaded into containers 10, and as such are even more particularly soft and malleable, further enhancing the usefulness of the substantially flat and smooth upper surface 130 of base 12 in preventing damage to the recently baked goods.

As discussed supra, cones or projections 120*a, b* further comprise a plurality of grid openings as shown in detail in FIG. 16. Because baked goods in general, and preferably tortillas, are loaded into containers 10 soon after they are baked, they are generally still fairly warm, and have a substantial amount of heat stored within them. Cones or base projections 120*a, b* comprise a plurality of openings at the top-most portion formed by the intersection of cone cross-pieces 126 (as discussed supra); this causes cones or projections 120*a, b* to act as a chimney when a lower container 10 has an upper container 10' placed on top of lower container 10 in the 180° stacking orientation (which is discussed in detail infra). The heat being given off from the freshly baked goods rises and escapes from the lower container's 10 interior portion through upper container's 10' cones or base projections 120*a', b'*. If multiple containers 10, 10' are stacked upon each other, after being loaded with freshly baked goods, the net effect is that all the cones or base projections 120*a, b* line up vertically and provide or form a chimney for the heat to escape. If the heat did not escape, it could otherwise cause overheating of the plastic the containers are manufactured from, or the plastic containers the baked goods are packaged within. Further still, the excess heat could cause condensation on or in the packages of baled goods if it has not escaped and the loaded containers are placed outside in a colder environment.

F. 0° Nesting

0° nesting describes the orientation of at least two containers 10 when an upper container 10' is placed within a lower, similar container 10, such that all four sides of the upper container 10' face the same direction as the lower container 10. 0° nesting is used, according to an exemplary embodiment of the present invention, for the purpose of storing and/or transporting empty or substantially empty containers 10.

Figure 11:
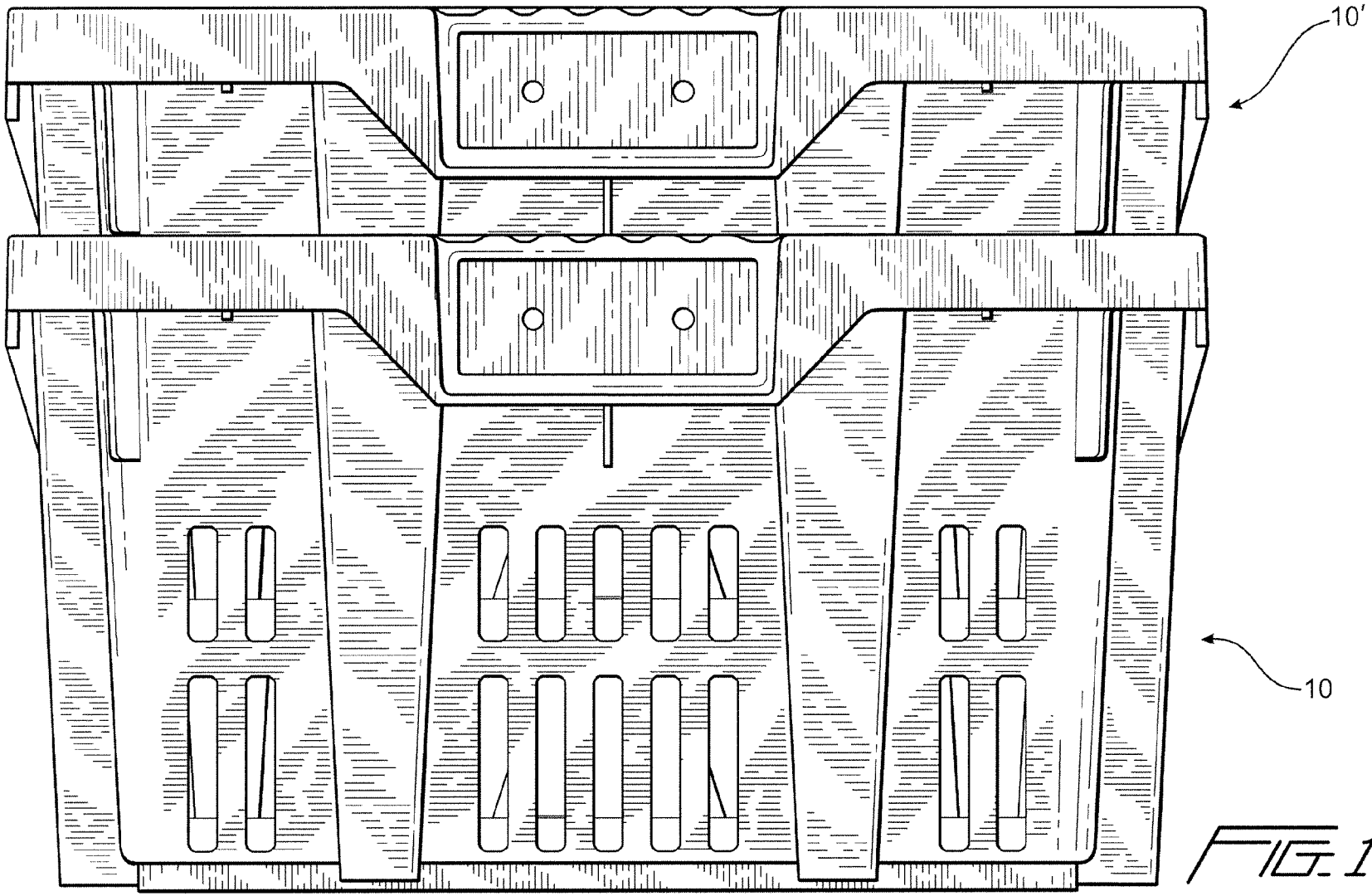
FIG. 11 illustrates a right side view of the containers shown in FIG. 10 in a substantially fully nested orientation according to an embodiment of the present invention.
Figure 12:
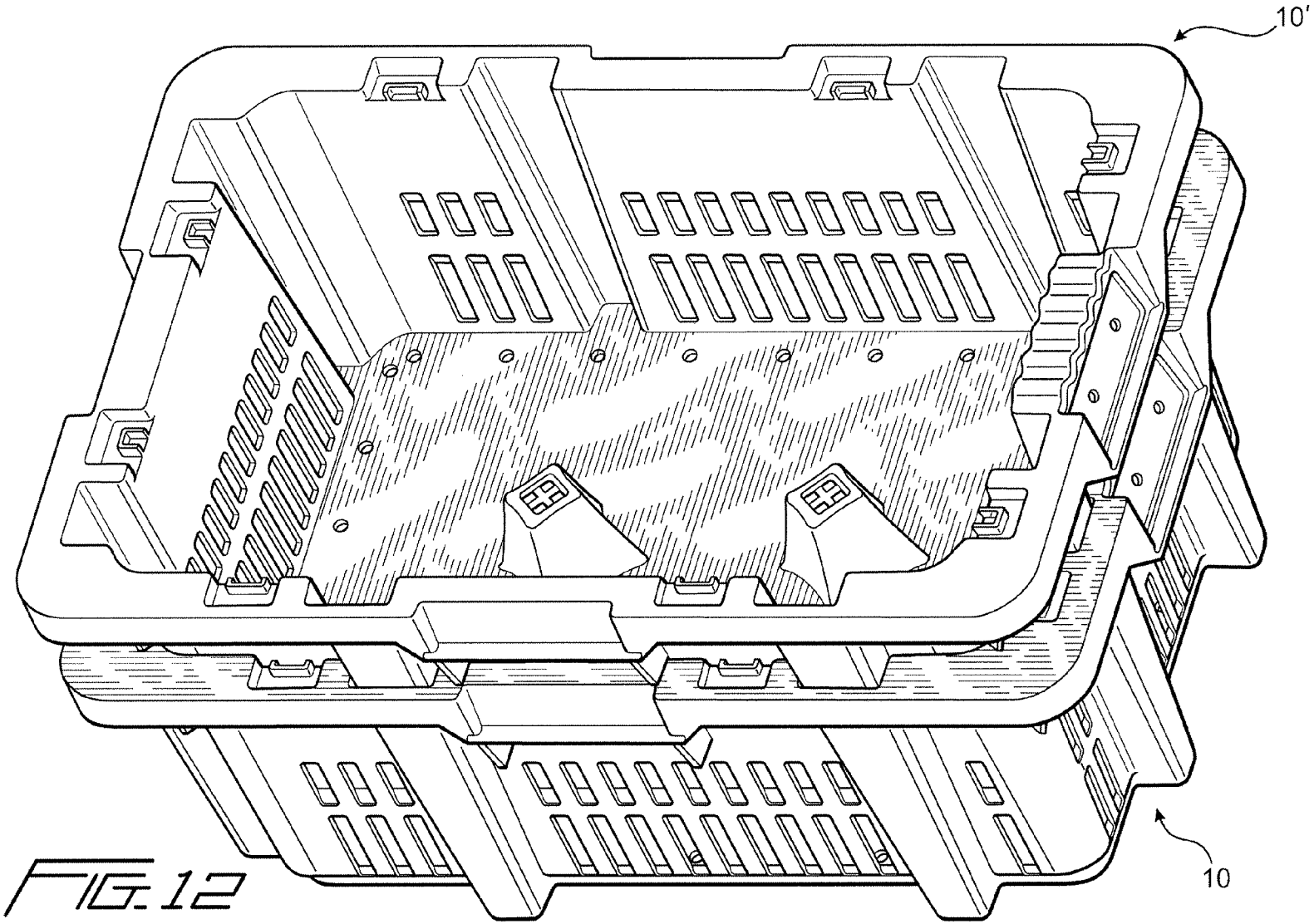
FIG. 12 illustrates a top perspective view of the containers shown in FIG. 10 in a substantially fully nested orientation according to an embodiment of the present invention.

FIG. 10 illustrates a front view of an upper container substantially fully nested within a lower container in a 0° nesting orientation according to an embodiment of the present invention, FIG. 11 illustrates a right side view of the containers shown in FIG. 10 in a substantially fully nested orientation according to an embodiment of the present invention, and FIG. 12 illustrates a top perspective view of the containers shown in FIG. 10 in a substantially fully nested orientation according to an embodiment of the present invention. Referring to FIGS. 10-12, upper container 10' is substantially nested within lower container 10 in a 0° nesting orientation. According to a preferred embodiment of the present invention, an upper container 10' is 0° nested within a lower container 10' when the upper container 10' is placed, or positioned, within the lower container 10, and front wall 2' of upper container 10' faces the same direction as front wall 2 of the lower container 10, as do all the other walls. All the stacking feet of each respective 0° wall of upper container 10' fits within their respective 0° nesting feet channels of lower container 10. That is, left front wall stacking foot 14*a* slides into, and rests within, left front 0° nesting feet channel 36*a*; right front wall stacking foot 14*b'* slides into, and rests within, right front 0° nesting feet channel 36*b*; front right side wall stacking foot 40*a'* slides into, and rests within, front right side wall 0° nesting feet channel 62*a*; rear right side wall stacking foot 40*b'* slides into, and rests within, rear right side wall 0° nesting feet channel 62*b*; right rear wall stacking foot 68*b'* slides into, and rests within, right rear 0° nesting foot channel 90*b*; left rear wall stacking foot 68*a'* slides into, and rests within, left rear 0° nesting foot channel 90*a*; rear left side wall stacking foot 94*b'* slides into, and rests within, rear left side wall 0° nesting foot channel 116*b*; and front left side wall stacking foot 94*a'* slides into, and rests within, front left side wall 0° nesting foot channel 116*a*.

According to a preferred embodiment of the present invention, the vertical nesting support plates facilitate 0° nesting, by supporting upper containers 10' on lower containers 10, such that the upper containers 10' do not become wedged too tightly into lower containers 10. For example, referring to FIGS. 3-6, and 10-12, vertical nesting support plates 34*a'-d'* (of upper container 10') rests upon front wall rim horizontal portion 30; vertical nesting support plate 60' rests upon right side wall rim horizontal portion 56; vertical nesting support plate 88*a'-d'* rests upon rear wall rim horizontal portion 84; and vertical nesting support plate 114' rests upon left side wall rim horizontal portion 110. Use of the vertical nesting support plates substantially prevents upper container 10' from wedging into lower container 10. Left and right cones 120*a, b* of lower container 10 are also substantially prevented from wedging into left and right cones 120*a', b'* of upper container 10'.

The height of container 10, according to an exemplary embodiment of the present invention, is about 8.75"; when two containers are placed in the 0° nesting orientation, the total height is about 11.75". Thus, each additional container placed in the 0° nesting orientation adds about 3.00" to the height of the stack. When four containers are placed in the 0° nesting orientation on top of each other, the total height is about 17.75"; the three additional containers take the same amount of space of about one additional container. This corresponds to a nesting ratio of about 3:1. Of course, as one of ordinary skill in the art of the present invention can appreciate, the nesting ratio can be designed to be any reasonable value.

According to an exemplary embodiment of the present invention, the amount of nesting is partially determined by the angle of the walls; the steeper the angle (i.e., the closer to 90° they approach), the less the nesting ratio will be. Conversely, the shallower the angle of the walls, the greater the nesting ratio. According to an exemplary embodiment of the present invention, cones or base projections 120*a, b* also provide stops for nesting and affect the amount of nesting; that is, when an upper container 10' is placed on a lower container 10, ribbed lower surface 128 rests upon cones upper surface 124 of cones or base projections 120*a, b*. A 3:1 nesting ratio provides operators of containers 10 with the ability to return almost three times as many containers in a return trip, on a per-volume basis, as were delivered. The 3:1 nesting ratio maximizes the amount of containers 10 that can be returned by a truck. There is, as one of ordinary skill in the art can appreciate, a tradeoff between higher nesting ratios and lower nesting ratios. If the nesting ratio is extremely large, then the angle of the walls is very shallow, and volumetric efficiency of container 10 suffers. On the contrary, if the nesting ratio is small (i.e., no nesting), then there is no advantage or efficiency in returning empty containers; each truckload can only carry the same amount of empty and loaded containers.

G. 180° Stacking

Figure 13:
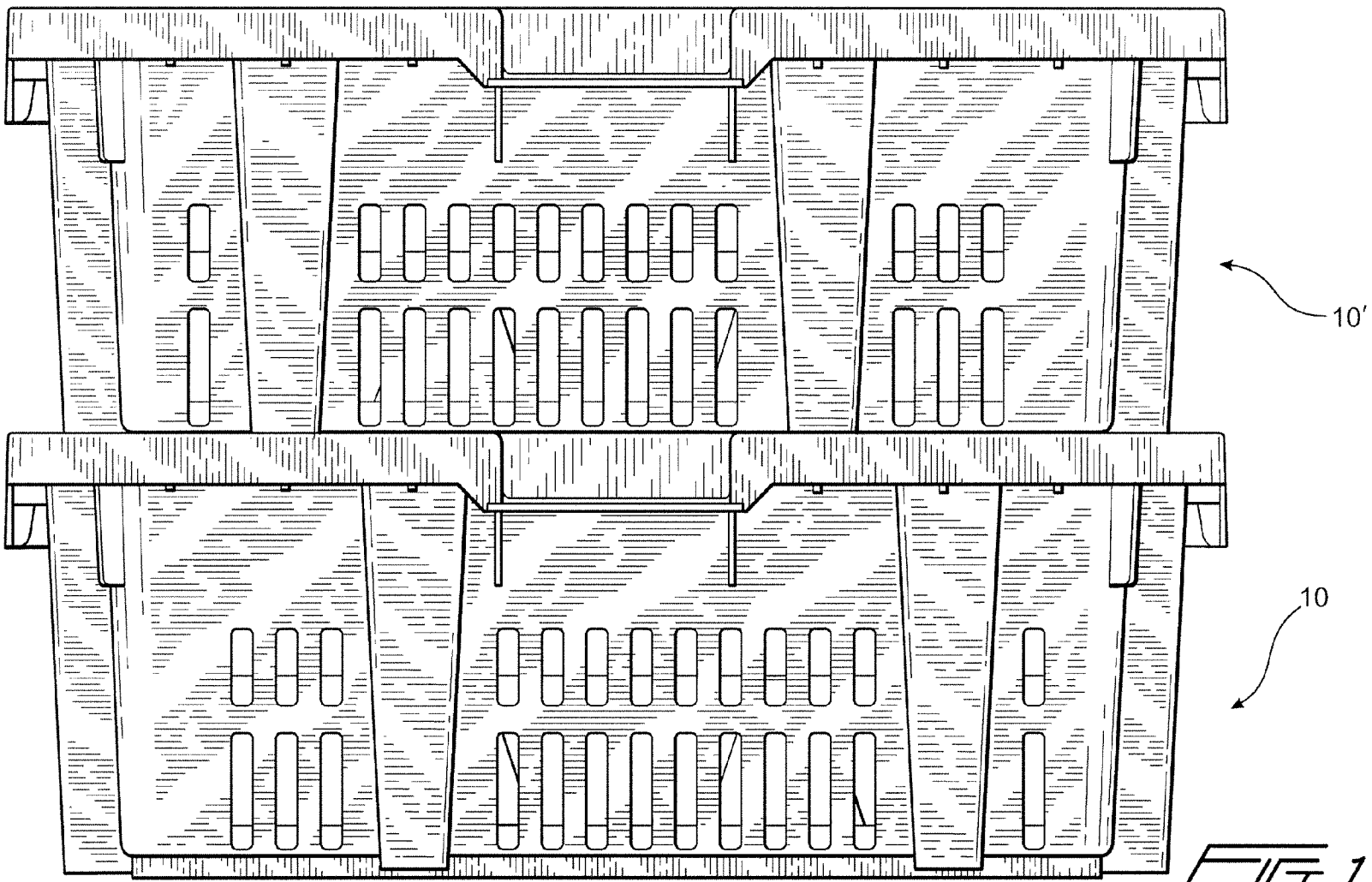
FIG. 13 illustrates a front view of an upper container located on a lower container in a 180° stacking orientation according to an embodiment of the present invention.

180° stacking describes the orientation of at least two containers when an upper, substantially similar container 10' is placed on a lower container 10 such that rear wall 6' of upper container 10' faces the same direction as front wall 2' of lower container 10, right side wall 4' of upper container 10' faces the same direction as left side wall 8 of lower container 10, left side wall 8' of upper container 10' faces the same direction as right side wall 4 of lower container 10, and front wall 2' of upper container 10' faces the same direction as rear wall 6 of lower container 10. According to a preferred embodiment of the present invention, 180° stacking is used when at least the lower container 10' is filled, either partially or wholly, with baked goods. FIG. 13 illustrates a front view of an upper container located on a lower container in a 180° stacking orientation according to an embodiment of the present invention, FIG. 14 illustrates a right side view of the containers shown in FIG. 13 in a 180° stacking orientation according to an embodiment of the present invention, and FIG. 15 illustrates a top perspective view of the containers shown in FIG. 13 in a 180° stacking orientation according to an embodiment of the present invention.

Figure 14:
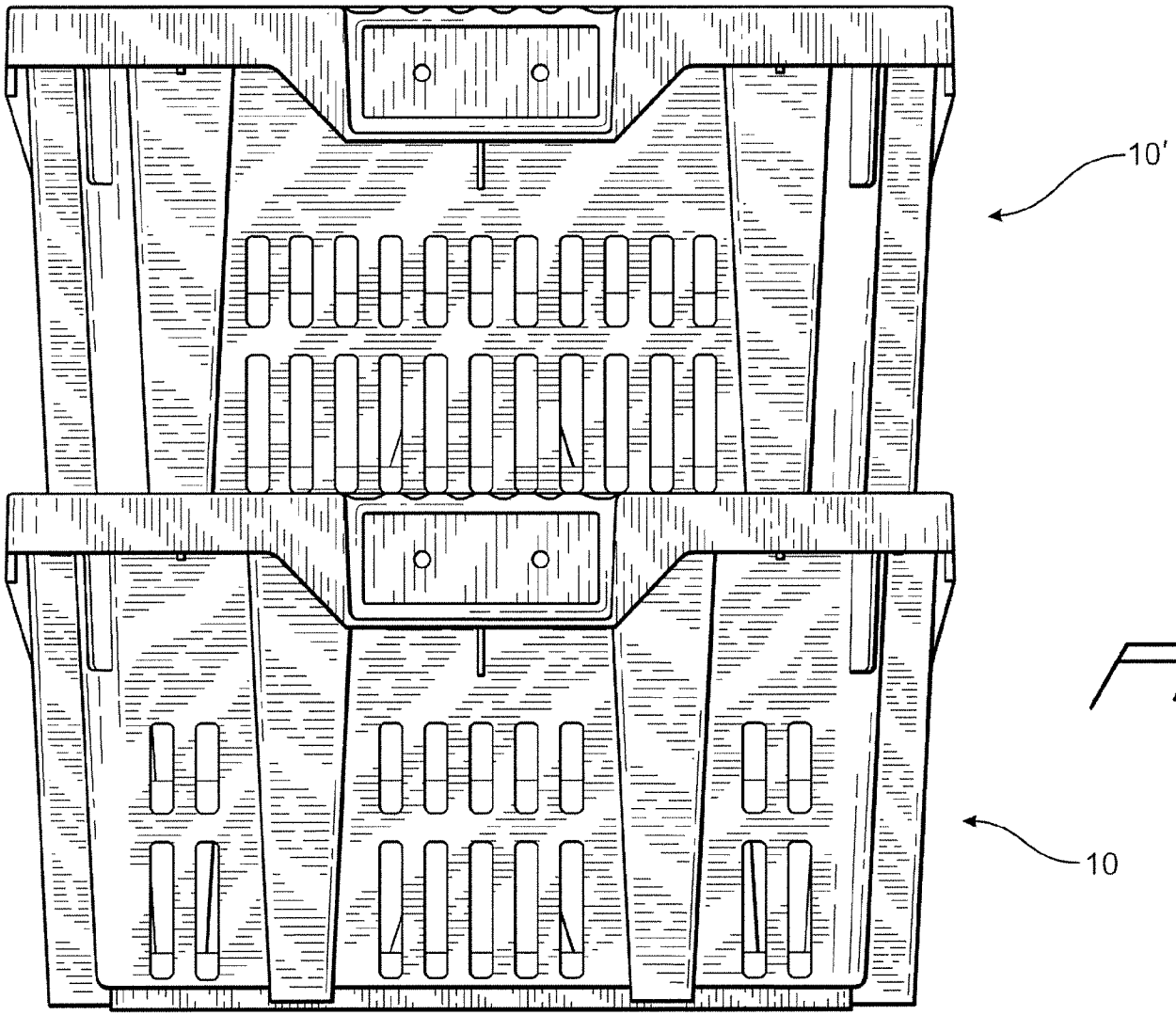
FIG. 14 illustrates a right side view of the containers shown in FIG. 13 in a 180° stacking orientation according to an embodiment of the present invention.
Figure 15:
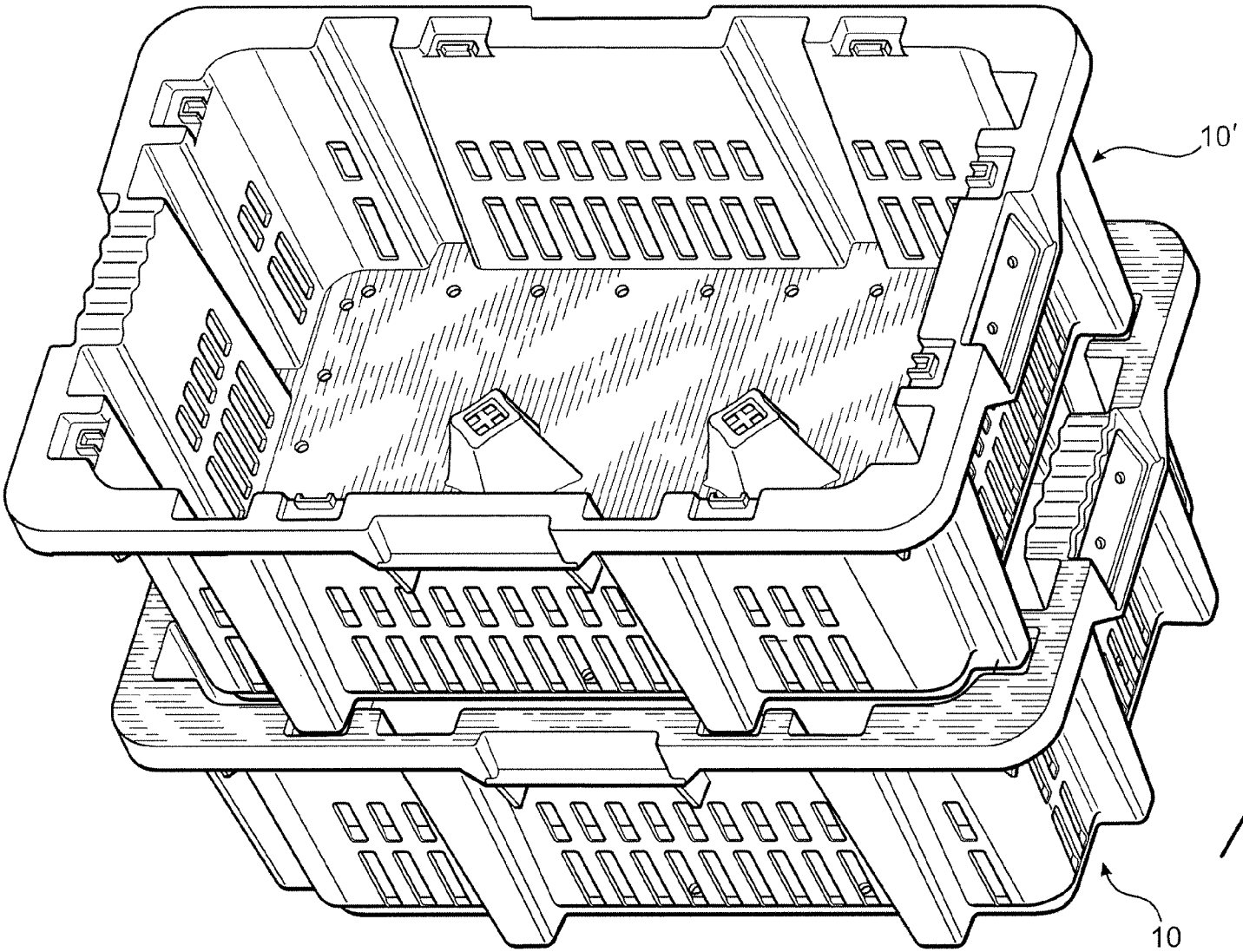
FIG. 15 illustrates a top perspective view of the containers shown in FIG. 13 in a 180° stacking orientation according to an embodiment of the present invention.

Referring to FIGS. 13-15, upper container 10' is located in the 180° stacking orientation in regard to lower container 10. In the 180° stacking orientation, upper container 10' is 180° stacked upon lower container 10' such that rear wall 6' of upper container 10' is located over front wall 2 of lower container 10, and right rear stacking foot 68*b*' is placed onto left front wall 180° stacking recess 24*a*. According to a preferred embodiment of the present invention, when right rear stacking foot 68*b*' is placed onto left front wall 180° stacking recess 24*a*, right rear wall stacking foot recess 92*b*' fits about left front wall 180° stacking recess projection 26*a*, thereby substantially preventing movement of right rear stacking foot 68*b* within left front wall 180° stacking recess 24*a*. In the 180° stacking orientation, according to an exemplary embodiment of the present invention, left rear stacking foot 68*a*' is placed onto right front wall 180° stacking recess 24*b*. According to a preferred embodiment of the present invention, when left rear stacking foot 68*a*' is placed onto right front wall 180° stacking recess 24*b*, left rear wall stacking foot recess 92*a*' fits about right front wall 180° stacking recess projection 26*b*, thereby substantially preventing movement of left rear stacking foot 68*a*' within right front wall 180° stacking recess 24*b*.

In the 180° stacking orientation, left side wall 8' of upper container 10' is located above right side wall 4 of lower container 10. Referring now to FIGS. 5, 6, 13 and 14, in the 180° stacking orientation, according to an exemplary embodiment of the present invention, rear left side wall stacking foot 94*b*' is placed onto front right side wall 180° stacking recess 50*a*. When rear left side wall stacking foot 94*b*' is placed onto front right side wall 180° stacking recess 50*a*, front left side wall stacking foot recess 118*b*' fits about front right side wall 180° stacking recess projection 52*a*, thereby substantially preventing movement of rear left side wall stacking foot 94*b*' within front right side wall 180° stacking recess 50*a*. Also as shown FIGS. 5, 6, 13 and 14, in the 180° stacking orientation, front left side wall stacking foot 94*a*' is placed onto rear right side wall 180° stacking recess 50*b*. According to a preferred embodiment of the present invention, when front left side wall stacking foot 94*a*' is placed onto rear right side wall 180° stacking recess 50*b*, rear left side wall stacking foot recess 118*a*' fits about rear right side wall 180° stacking recess projection 52*b*, thereby substantially preventing movement of front left side wall stacking foot 94*a*' within rear right side wall 180° stacking recess 50*b*.

In the 180° stacking orientation, front wall 2' of upper container 10' is located over rear wall 6 of lower container 10. Referring to FIGS. 3 and 4, according to an exemplary embodiment of the present invention, left front wall stacking foot 14*a*' is placed onto right rear wall 180° stacking recess 78*b*. According to a preferred embodiment of the present invention, when left front wall stacking foot 14*a*' is placed onto right rear wall 180° stacking recess 78*b*, left front wall stacking foot recess 38*a*' fits about right rear wall 180° stacking recess projection 80*b*, thereby substantially preventing movement of left front wall stacking foot 14*a*' within right rear wall 180° stacking recess 78*b*. Also as shown in FIGS. 5 and 6, in the 180° stacking orientation, right front wall stacking foot 14*b*' is placed onto left rear wall 180° stacking recess 78*a*. According to a preferred embodiment of the present invention, when right front wall stacking foot 14*b*' is placed onto left rear wall 180° stacking recess 78*a*, right front wall stacking foot recess 38*b*' fits about left rear wall 180° stacking recess projection 80*a*, thereby substantially preventing movement of right front wall stacking foot 14*b*' within left rear wall 180° stacking recess 78*a*.

In the 180° stacking orientation, right side wall 4' of upper container 10' is located over left side wall 8 of lower container 10. Referring to FIGS. 5 and 6, in the 180° stacking orientation, front right side wall stacking foot 40*a*' is placed onto rear left side wall 180° stacking recess 104*b*. According to a preferred embodiment of the present invention, when front right side wall stacking foot 40*a*' is placed onto rear left side wall 180° stacking recess 104*b*, front right side wall stacking foot recess 64*a*' fits about rear left side wall 180° stacking recess projection 106*b*, thereby substantially preventing movement of front right side wall stacking foot 40*a*' within rear left side wall 180° stacking recess 104*b*. Also as shown in FIGS. 5 and 6, in the 180° stacking orientation, rear right side wall stacking foot 40*b*' is placed onto front left side wall 180° stacking recess 104*a*. According to a preferred embodiment of the present invention, when rear right side wall stacking foot 40*b*' is placed onto front left side wall 180° stacking recess 104*a*, rear right side wall stacking foot recess 64*b*' fits about front left side wall 180° stacking recess projection 106*a*, thereby substantially preventing movement of rear right side wall stacking foot 40*b*' within front left side wall 180° stacking recess 104*a*.

According to a preferred embodiment of the present invention, in the 180° stacking orientation, the total combined height of lower container 10 and upper container 10' is about 17". This provides, according to an exemplary embodiment of the present invention, about 7.75" clearance, or product clearances between upper surface 130 of lower container 10, and ribbed lower surface 128' of upper container 10'. Therefore, according to an exemplary embodiment of the present invention, about 1" of the total height of container 10 is lost when placed in the 180° stacking orientation, thereby providing an efficient storage container when placed in the 180° stacking orientation In addition, because upper container 10' is stacked upon lower container 10 with the use of the 180° stacking recess projections (26*a, b*; 52*a, b*; 80*a, b*; and 106*a, b*), upper container 10' is securely stacked upon lower container 10, such that shifting and/or slipping of upper container 10 is substantially prevented. Thus, container 10 provides a significant amount of storage space for baked goods, which, according to an exemplary embodiment of the present invention, are preferably tortillas.

III. Container 210

Figure 9:
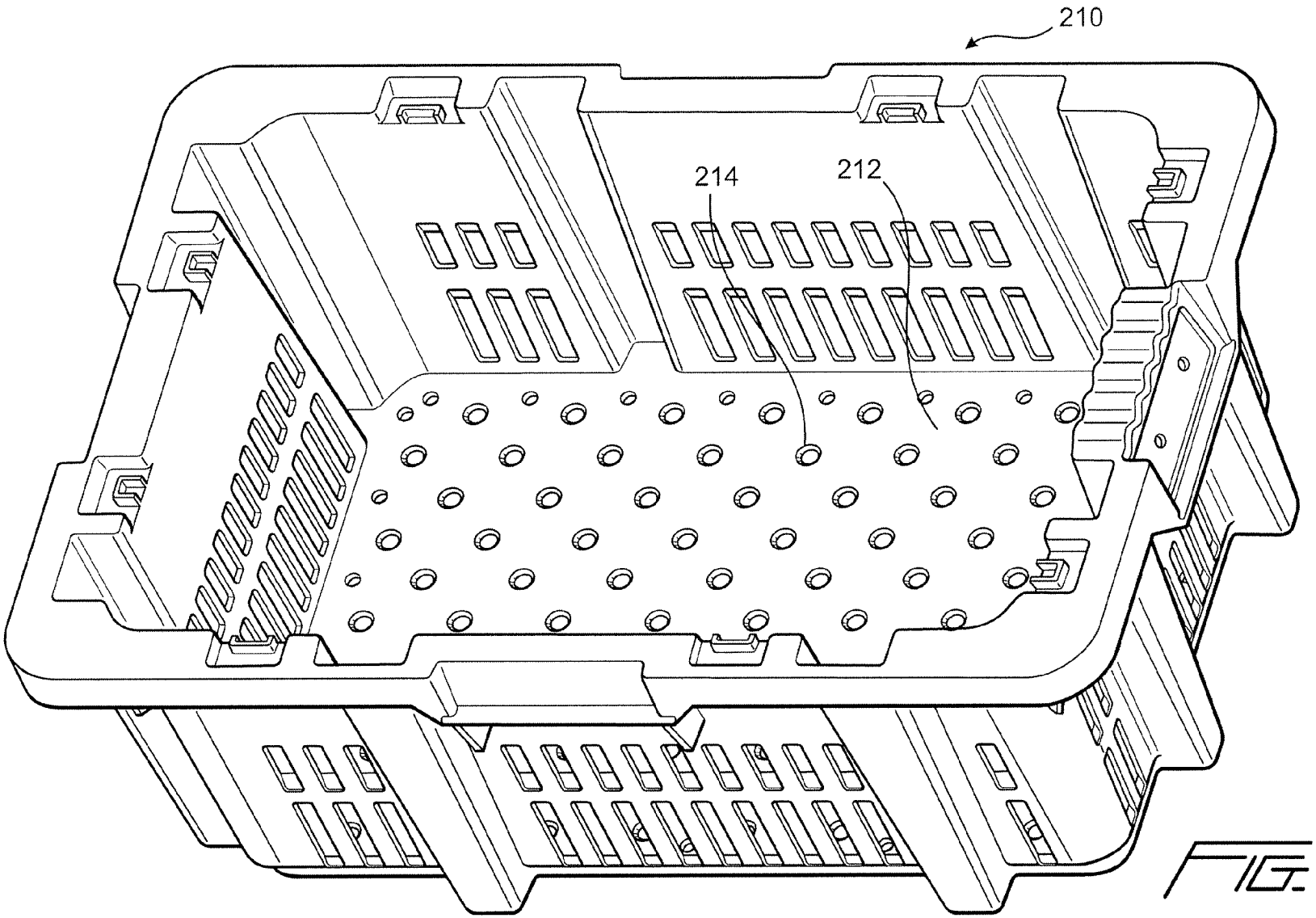
FIG. 9 illustrates a top perspective view of another container according to an alternative embodiment of the present invention.

Container 210, shown in FIG. 9, is substantially similar to container 10. As such, a detailed description as provided supra in regard to container 10 has been omitted for the sake of clarity. In nearly all respects, container 210 comprises the same or substantially identical features as container 10. For example, container 210 comprises substantially identical 0° nesting and 180° stacking features as described supra, and as shown in detail in FIG. 9. However, a difference between container 10 and container 210 is the composition of base 212, which omits cones 120*a, b*, and which further includes larger and more numerous drain holes 214. Container 210 is designed to carry, according to an exemplary embodiment of the present invention, baked goods, such as bagels, muffins, tortillas, fruit, other agricultural products, meat products, and practically anything of significant weight. Drain holes 214 are used to provide easier washing of container 210.

The present invention has been described with reference to certain exemplary embodiments thereof. However, it will be readily apparent to those skilled in the art that it is possible to embody the invention in specific forms other than those of the exemplary embodiments described above. This may be done without departing from the spirit and scope of the invention. The exemplary embodiments are merely illustrative and should not be considered restrictive in any way. The scope of the invention is defined by the appended claims and their equivalents, rather than by the preceding description.

All United States patents and applications, foreign patents, and publications discussed above are hereby incorporated herein by reference in their entireties.

What is claimed is:

1. A container for shipping and storage of packages of baked goods, comprising:

a front wall, a rear wall, a left side wall, a right side wall, and a base, wherein, each of the front wall, rear wall, left side wall, and right side wall are substantially orthogonal to the base; and a plurality of base projections located on an upper surface of the base of the container, wherein the base projections are configured to position two or more packages of baked goods such that the packages of baked goods are substantially prevented from sliding about an interior portion of the container, and wherein each of the plurality of base projections comprises:

a plurality of angled surfaces, rising from the upper surface of the base of the container; and an upper surface, wherein the upper surface is joined together with an upper portion of each of the plurality of angled surfaces; and a curved surface forming an inwardly concave cross-section when taken perpendicular to a height of each base projection, wherein a radius of curvature of each of the curved surfaces is substantially similar to a radius of curvature of the package of baked goods.

2. The container according to claim 1, wherein the upper surface comprises:

a plurality of cross pieces, wherein a first cross piece is fixedly attached to a first angled surface and a second oppositely located angled surface, and a second cross piece is fixedly attached to a third angled surface and a fourth oppositely located angled surface.

3. The container according to claim 2, wherein the plurality of cross pieces forms a grid with a plurality of openings.

4. The container according to claim 1, wherein the plurality of angled surfaces comprises four angled surfaces.

5. The container according to claim 1, wherein a height of each of the base projections is between about 20 percent and about 40 percent of an interior height of the walls of the container.

6. The container according to claim 1, wherein a height of each of the base projections is between about 25 percent and about 35 percent of an interior height of the walls of the container.

7. The container according to claim 1, wherein a height of each of the base projections is about 33.3 percent of an interior height of the walls of the container.

8. The container according to claim 1, wherein the plurality of base projections is configured to locate at least six separate stacks of packages of baked goods, such that the at least six separate stacks of packages of baked goods are substantially prevented from sliding about an interior portion of the container.

9. The container according to claim 8, wherein the plurality of base projections comprises two base projections.

10. The container according to claim 1, wherein the base projections are substantially truncated pyramid-shaped.

11. The container according to claim 1, wherein each of the base projections comprise an opening at an upper location of each of the base projections, such that each of the base projections of an upper container is configured to ventilate heat from a lower container that accumulates in the interior portion of the lower container after the container has been loaded with baked goods.

12. A container for shipping and storage of packages of baked goods, comprising:

a front wall, a rear wall, a left side wall, a right side wall, and a base, wherein, each of the front wall, rear wall, left side wall, and right side wall are substantially orthogonal to the base;

a rim surface located on an uppermost portion of each of the front wall, right side wall, rear wall, and left side wall;

a plurality of stacking feet, each stacking foot defining a corresponding recessed nesting channel along an interior surface of the container and having an opening on the rim surface adapted for receiving a corresponding stacking foot of a substantially identical upper container in a 0° stacking orientation, wherein each of the plurality of stacking feet includes a lowermost portion configured to be positioned upon a substantially identical lower container in a 180° stacking orientation, and wherein the lowermost portion includes a stacking foot recess; and a plurality of rim surface recesses, wherein each of the plurality of rim surface recesses includes a rim surface recess projection within each rim surface recess that rises substantially orthogonally from a lowermost surface of the corresponding rim surface recess, wherein each of the rim surface recess projections of the lower container is configured to be positioned within each of a respective stacking foot recess of each of the plurality of stacking feet when an upper container is stacked on a lower container in a 180° stacking orientation, and further wherein, each of the rim surface recess projections is further configured to substantially prevent shifting and movement of each of the respective corresponding stacking feet of the upper container positioned on each of the rim surface recess projections of the lower container, thereby substantially preventing shifting and movement of the upper container.

13. The container according to claim 12, wherein each of the plurality of rim surface recesses is substantially rectangular.

14. The container according to claim 12, wherein each of the plurality of rim surface recesses is substantially square.

15. The container according to claim 12, wherein each of the rim surface recess projections is substantially U-shaped.

16. The container according to claim 12, wherein each of the rim surface recess projections is substantially "[”-shaped.

17. The container according to claim 12, wherein each of the plurality of stacking foot recesses is substantially rectangular shaped.

18. The container according to claim 12, wherein each of the plurality of stacking foot recesses is substantially square shaped.

* * * * *